US008317349B2

(12) United States Patent
Hernandez

(10) Patent No.: US 8,317,349 B2
(45) Date of Patent: Nov. 27, 2012

(54) SYSTEM FOR LIGHTING REFRIGERATION CABINETS USING LED LIGHTS

(75) Inventor: Francisco Pineda Hernandez, Queretaro (MX)

(73) Assignee: Imbera, S.A. DE C.V., San Juan del Rio, Queretaro (MX)

( * ) Notice: Subject to any disclaimer, the term of this patent is extended or adjusted under 35 U.S.C. 154(b) by 25 days.

(21) Appl. No.: 12/918,610

(22) PCT Filed: Feb. 22, 2008

(86) PCT No.: PCT/MX2008/000025

§ 371 (c)(1), (2), (4) Date: Sep. 28, 2010

(87) PCT Pub. No.: WO2009/104946

PCT Pub. Date: Aug. 27, 2009

(65) Prior Publication Data

US 2011/0235307 A1 Sep. 29, 2011

(51) Int. Cl.
*F21V 33/00* (2006.01)

(52) U.S. Cl. ..... 362/92; 362/249.02; 362/217.02; 362/294

(58) Field of Classification Search ..... 362/92, 362/249.02, 235, 125, 126, 240, 433, 219, 362/800, 294; 62/264, 249; 312/223.5
See application file for complete search history.

(56) References Cited

U.S. PATENT DOCUMENTS

| | | | | |
|---|---|---|---|---|
| 5,655,830 | A * | 8/1997 | Ruskouski | 362/240 |
| 5,937,666 | A * | 8/1999 | Trulaske, Sr. | 62/264 |
| 6,283,612 | B1 * | 9/2001 | Hunter | 362/240 |
| 7,121,675 | B2 * | 10/2006 | Ter-Hovhannisian | 362/92 |
| 2010/0061079 | A1 * | 3/2010 | Li et al. | 362/92 |
| 2011/0304253 | A1 * | 12/2011 | Howington et al. | 312/405 |

FOREIGN PATENT DOCUMENTS

EP 1852648 A1 11/2007

* cited by examiner

*Primary Examiner* — Ali Alavi

(74) *Attorney, Agent, or Firm* — Miller, Matthias & Hull LLP

(57) ABSTRACT

The invention relates to a lighting system intended to light the interior of cabinets of the type used in commercial refrigerators, having glass doors. The system is based on a series of three interconnected LEDs mounted on a printed circuit board (PCB). The assembly is inserted into a diffusion tube, the shape of which enables optimized light emission and is designed for sections installed inside cabinet door frames. The LEDs can be powered by a current or voltage source and the manner in which the LEDs are housed along the inner periphery of the door enables the optimized lighting of the items on display.

13 Claims, 37 Drawing Sheets

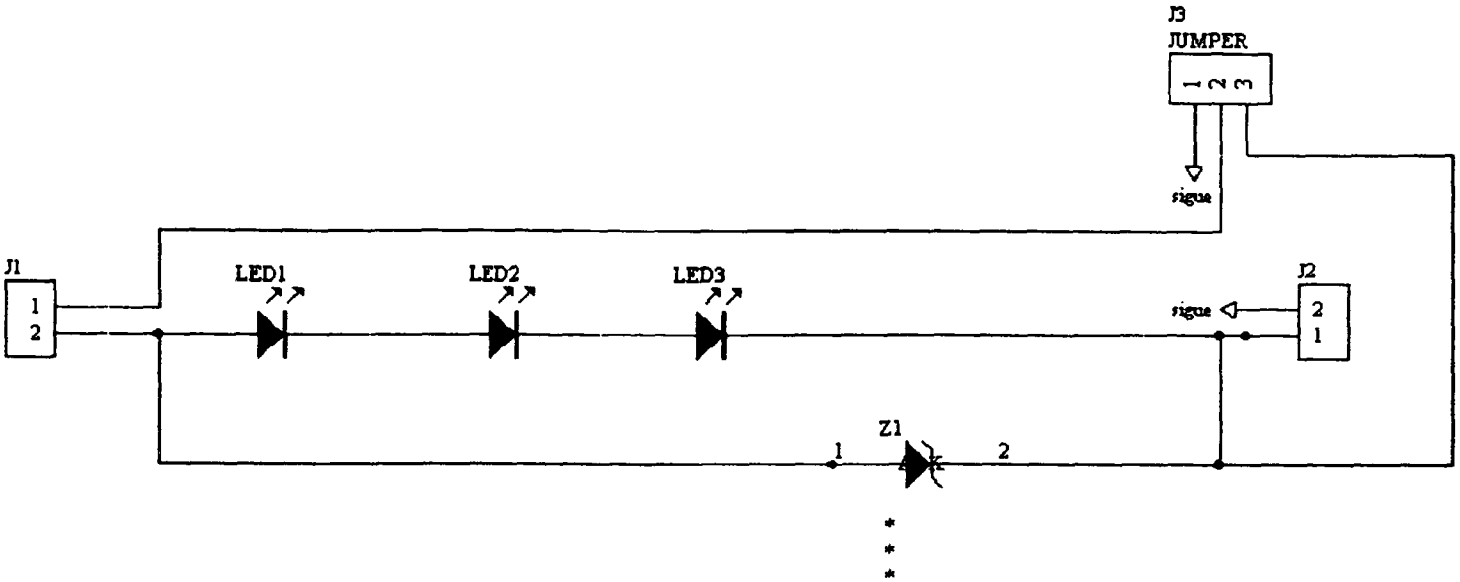
Figura 1 a

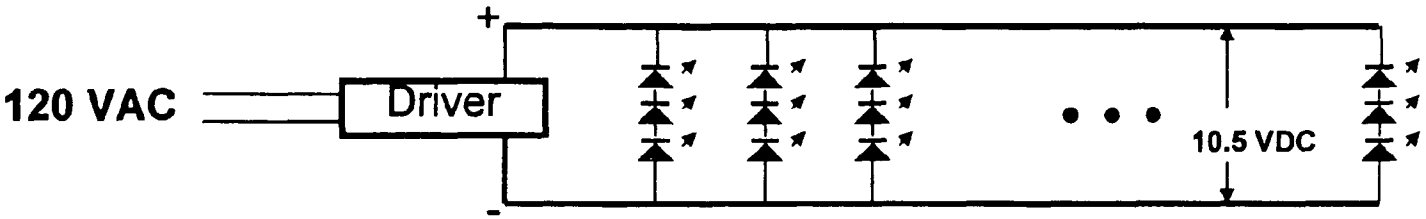
Figura 1 b

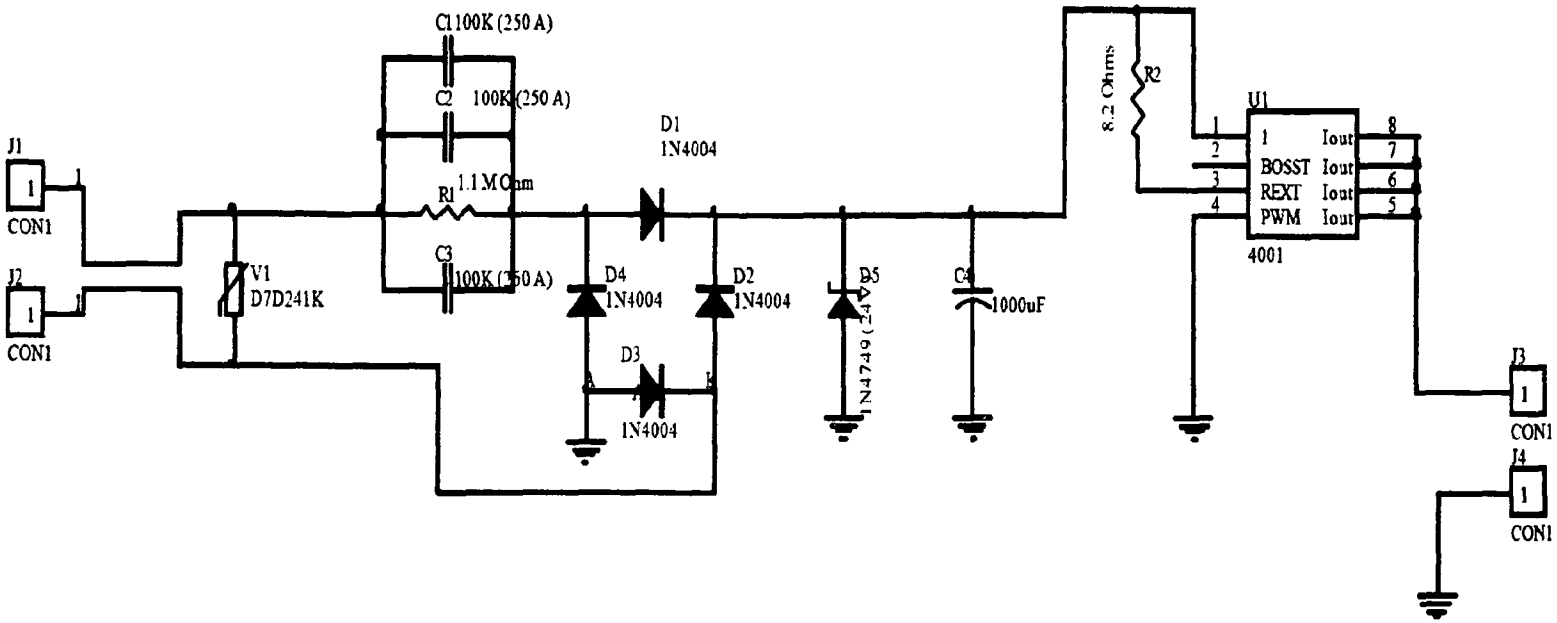
Figura 2a

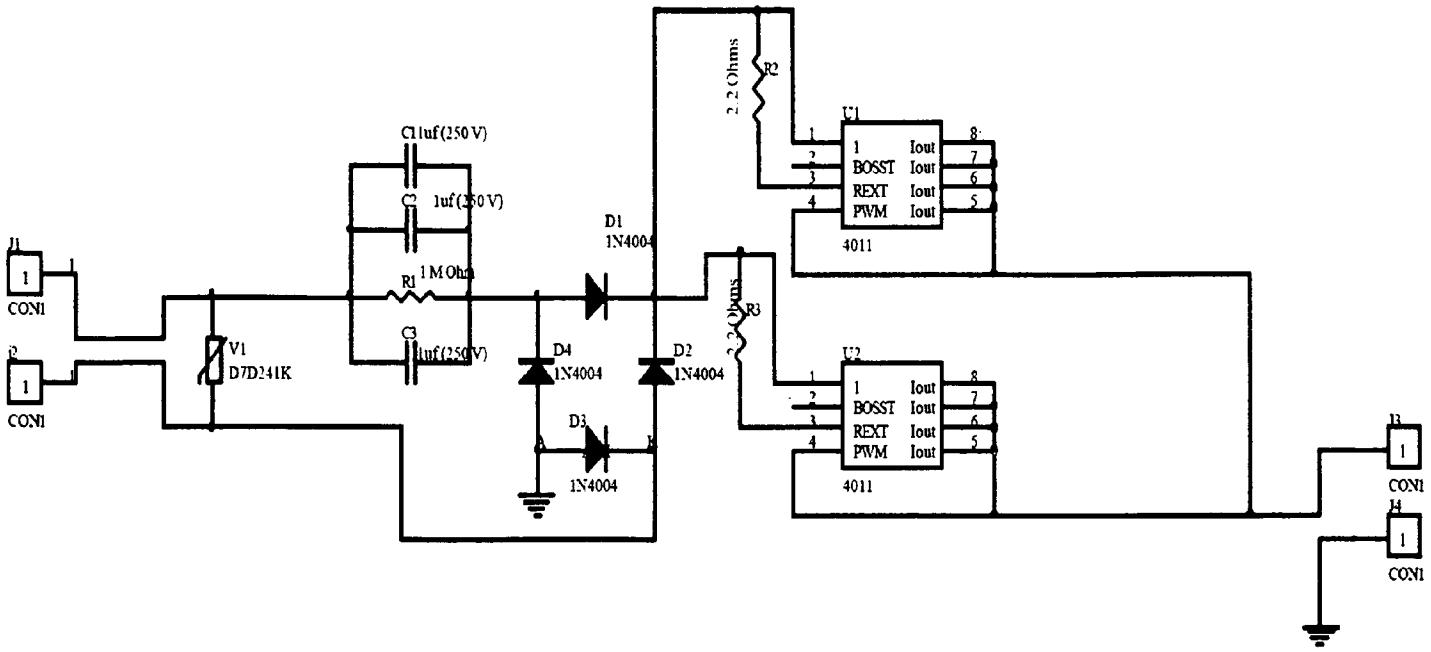
Figura 2b

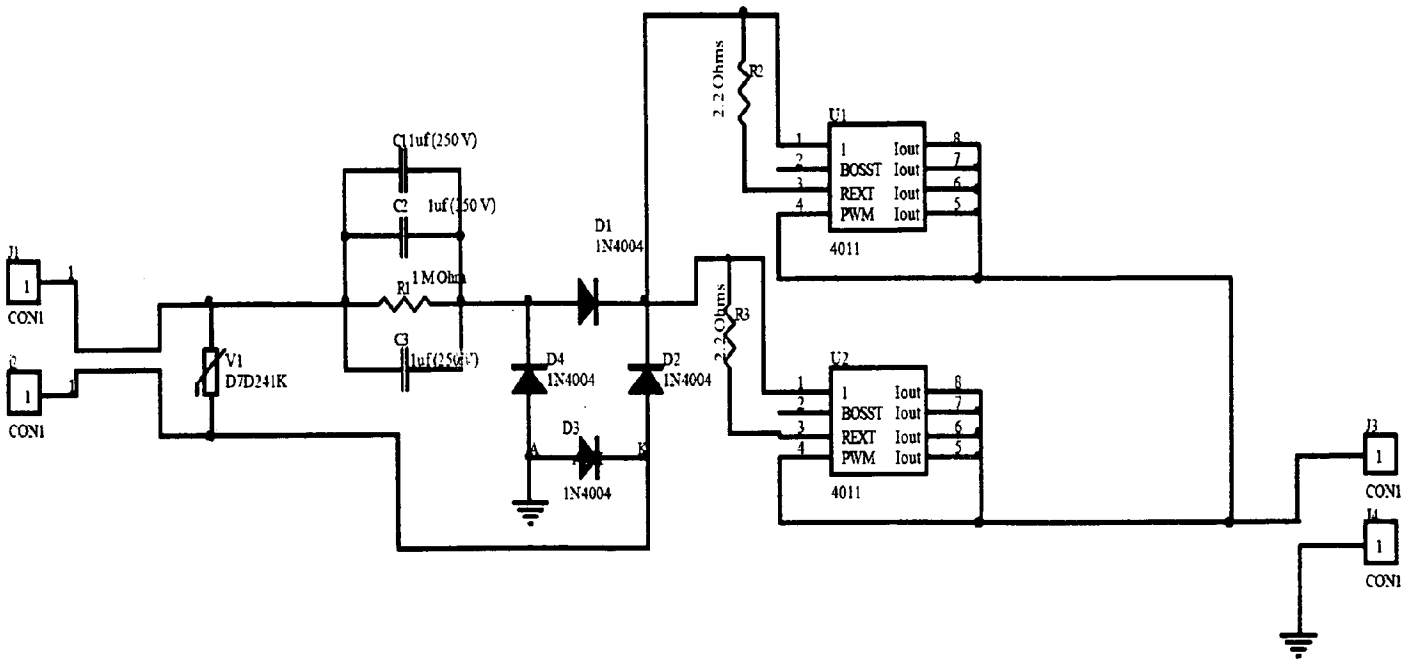
Figura 2c

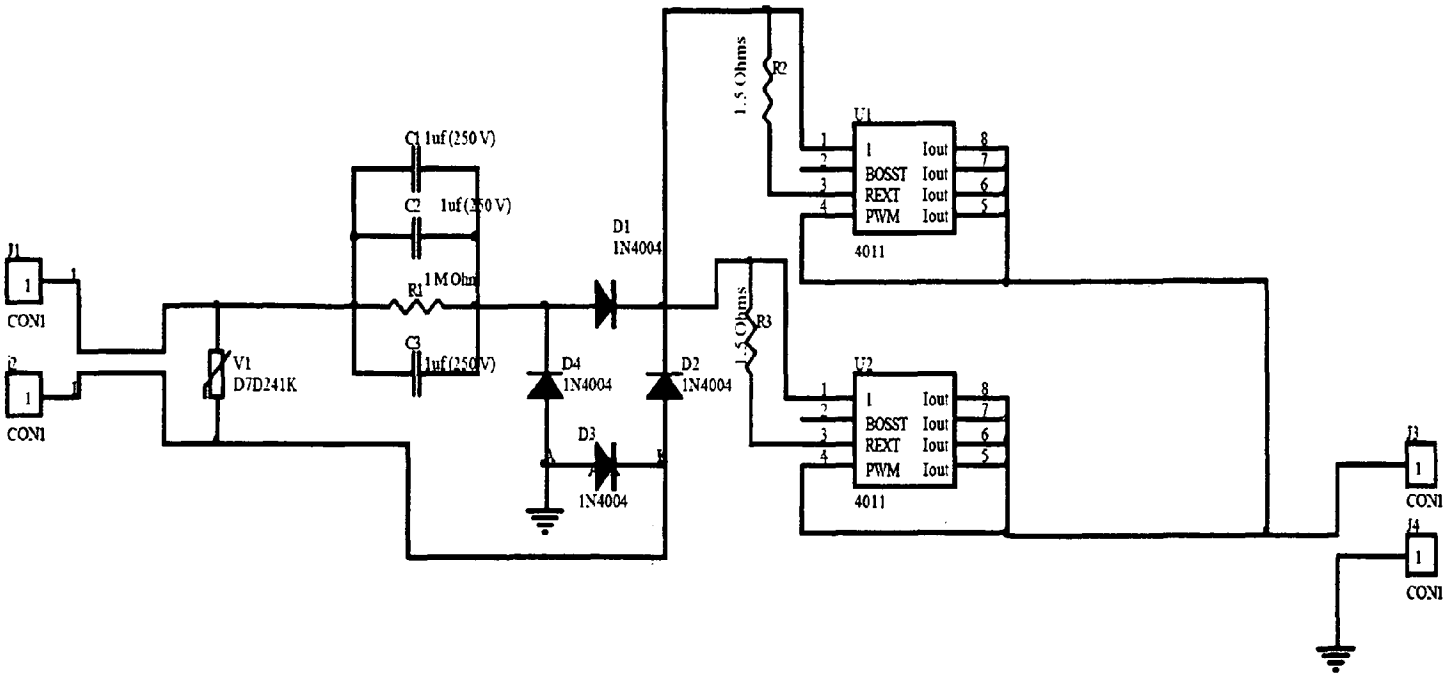
Figura 2d

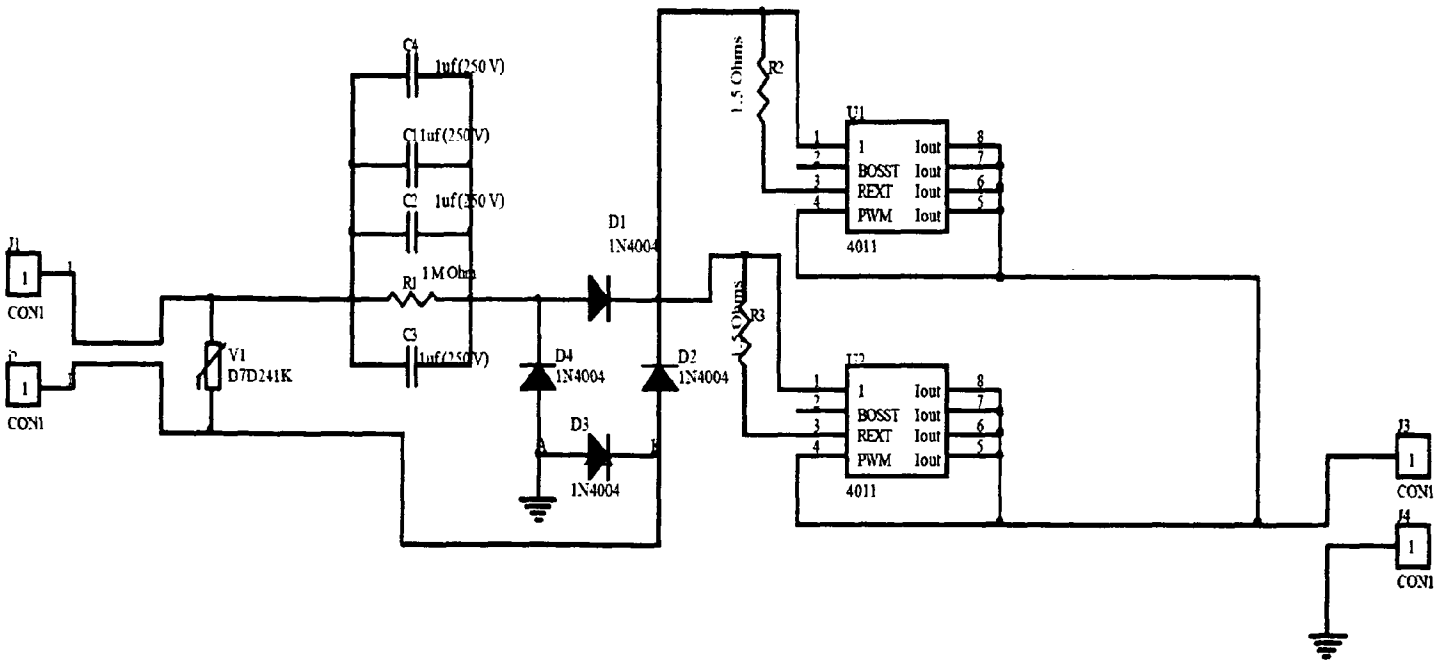
Figura 2e

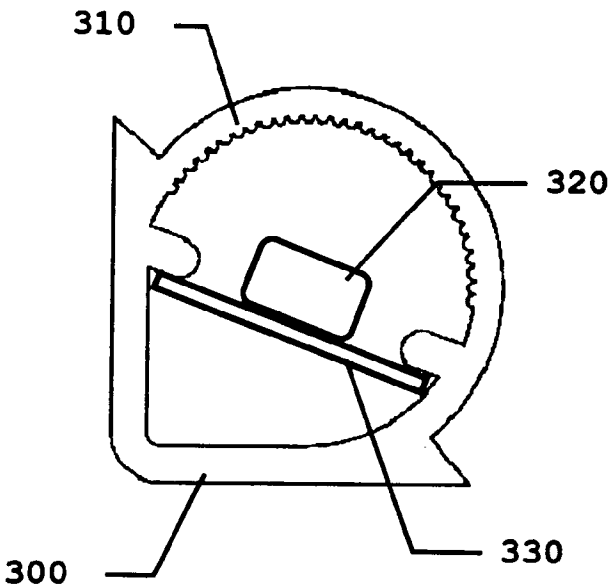
Figura 3b
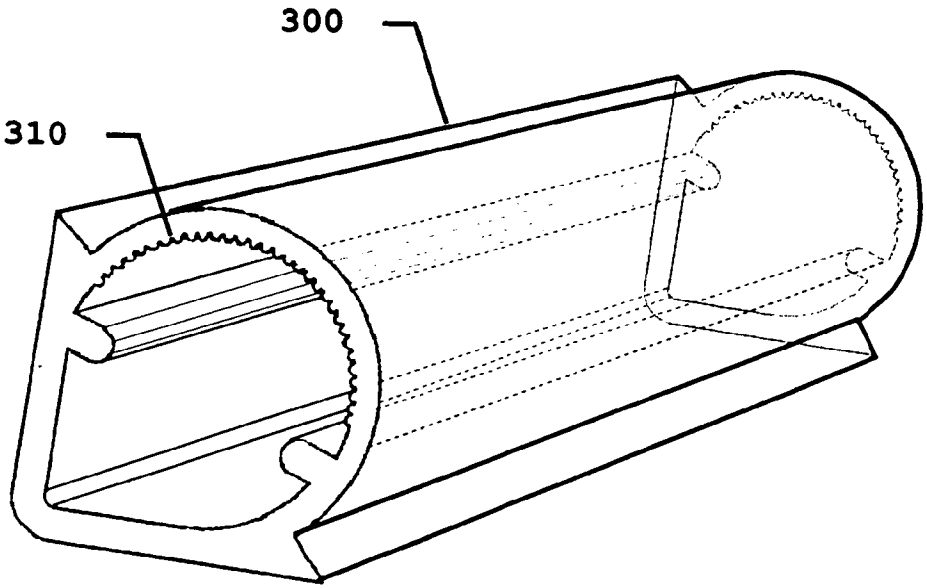
Figura 3a

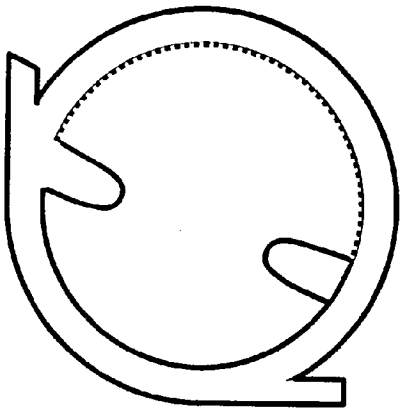
Figura 3c

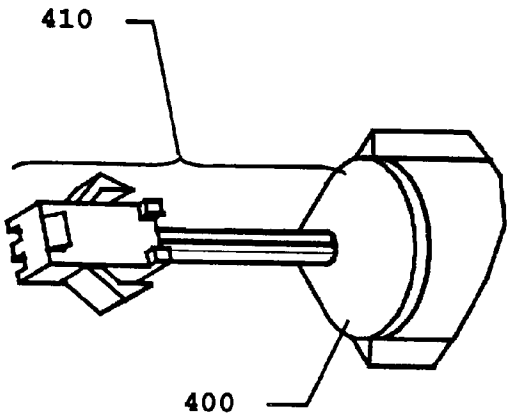
Figura 4

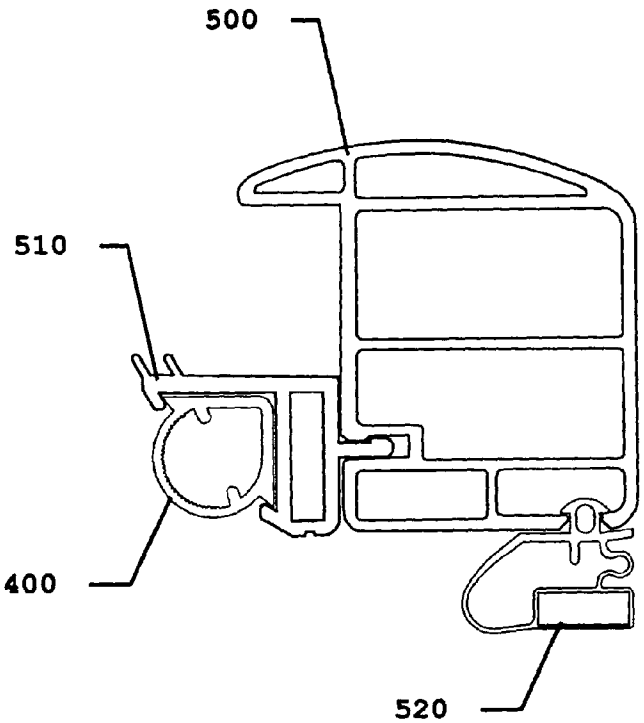
Figura 5

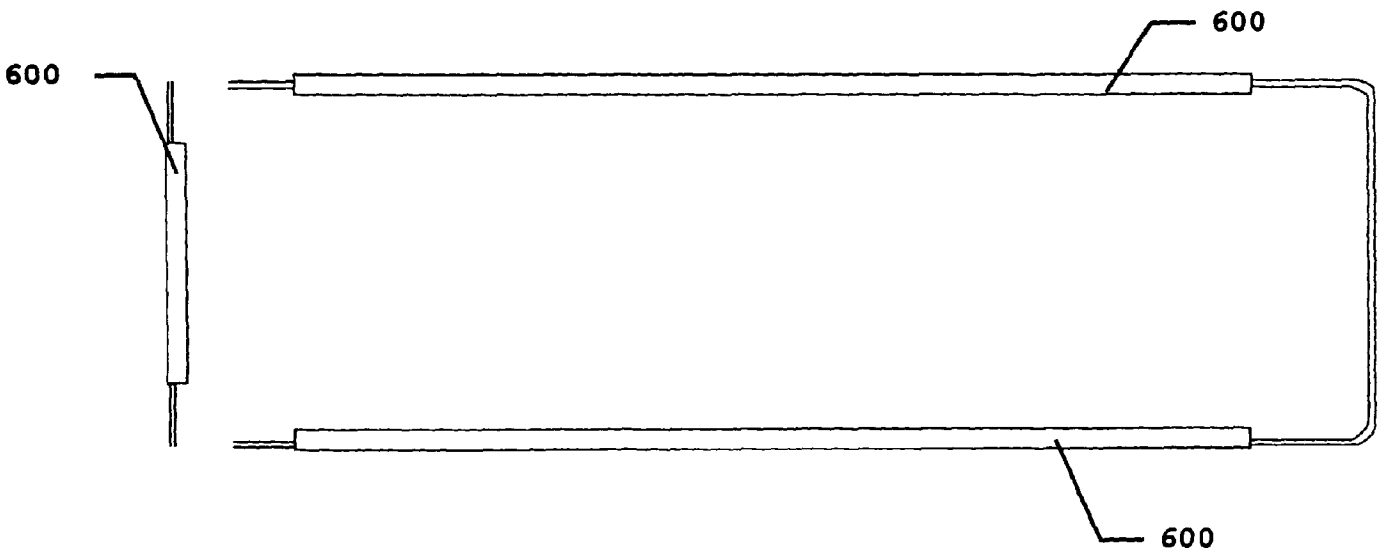
Figura 6

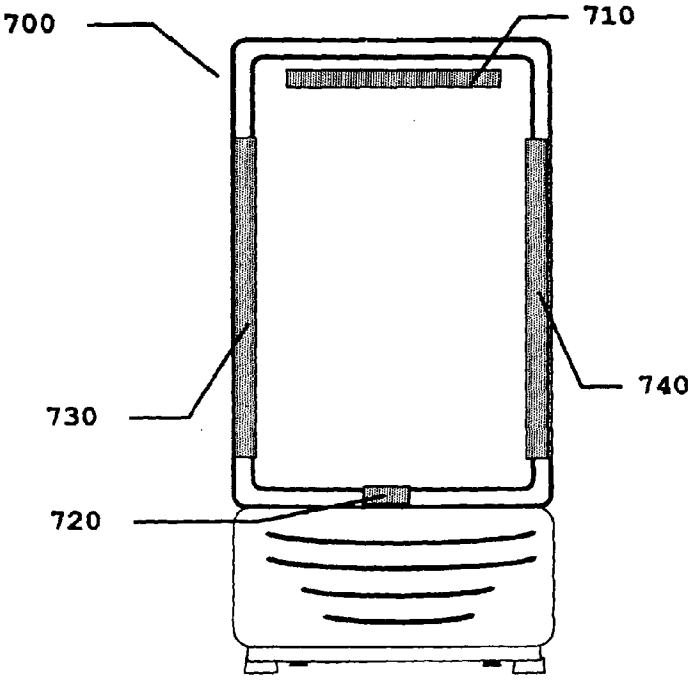
Figura 7a

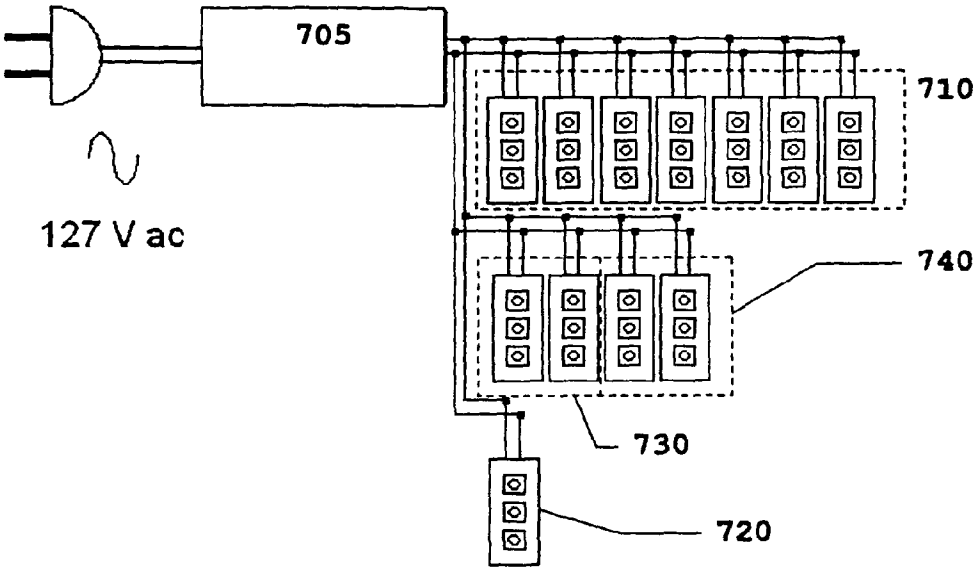
Figura 7b

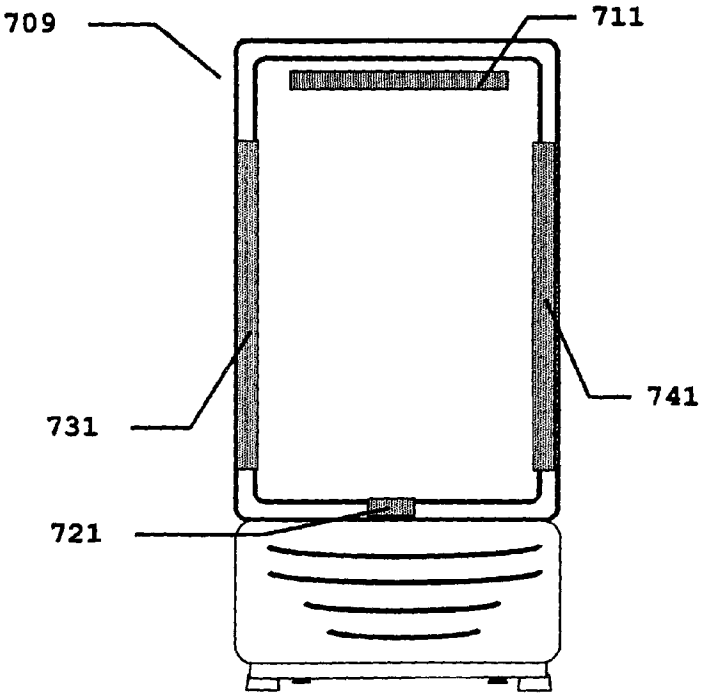
Figura 7c

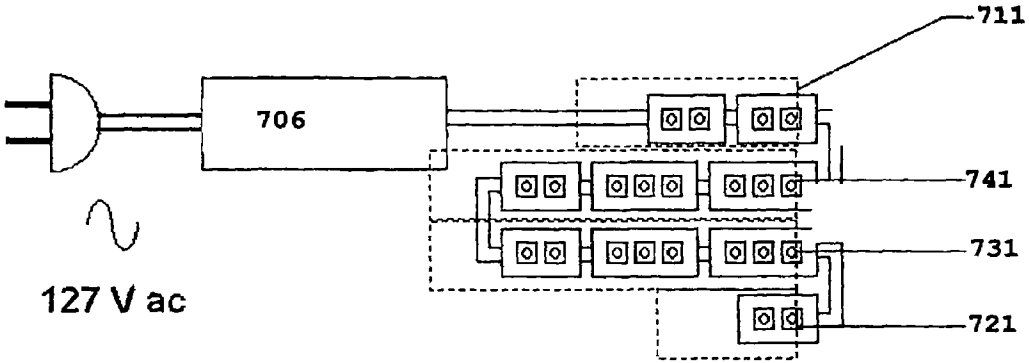
Figura 7d

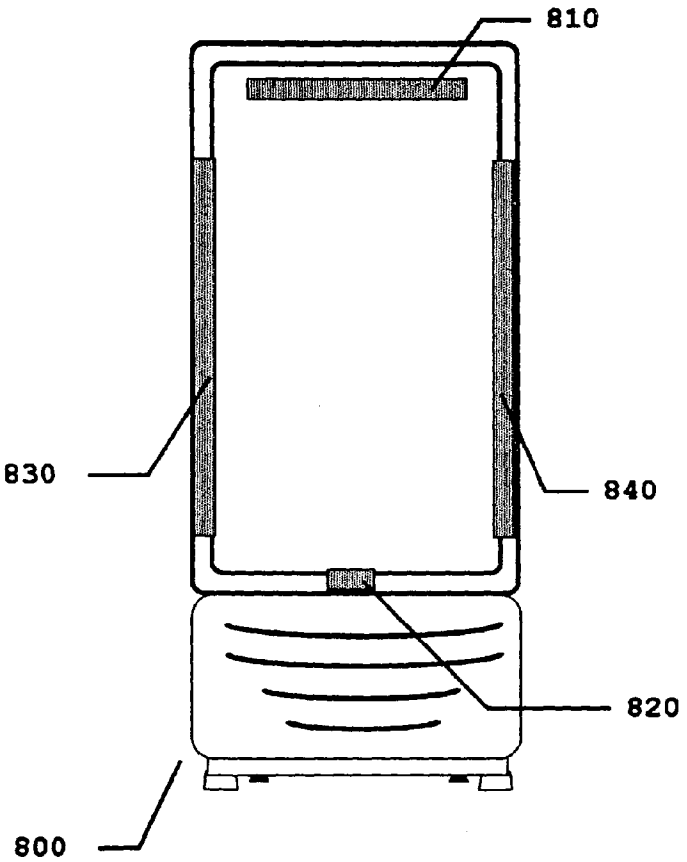
Figura 8a

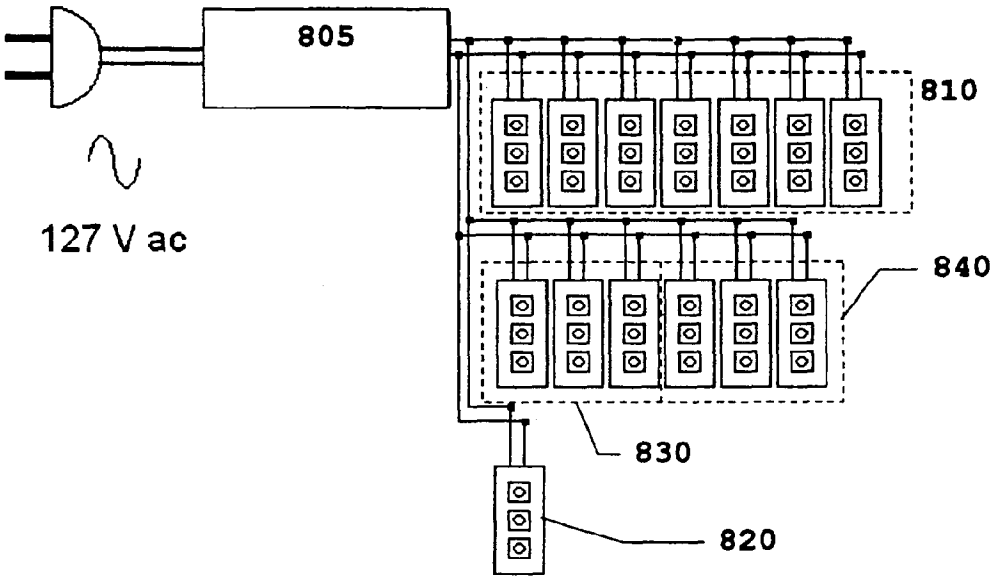
Figura 8b

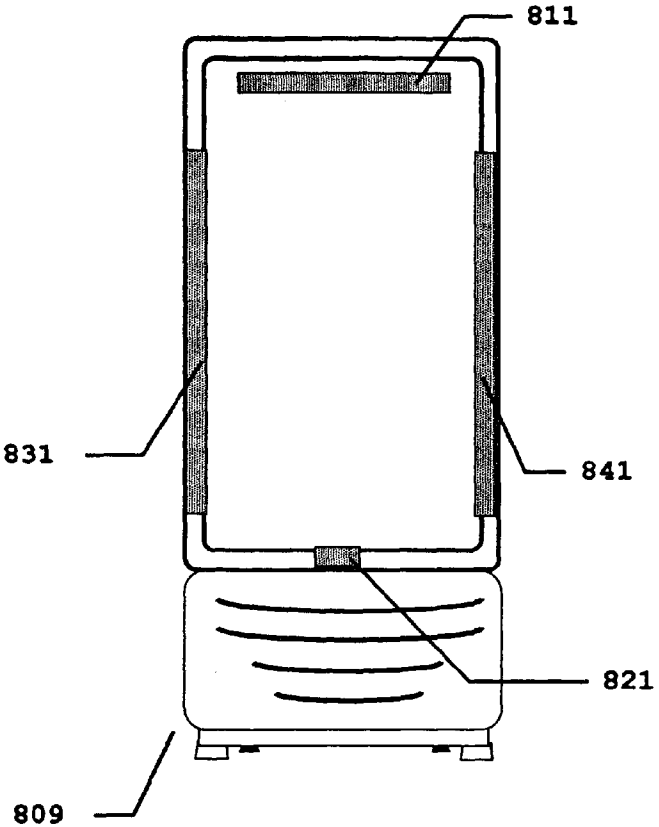
Figura 8c

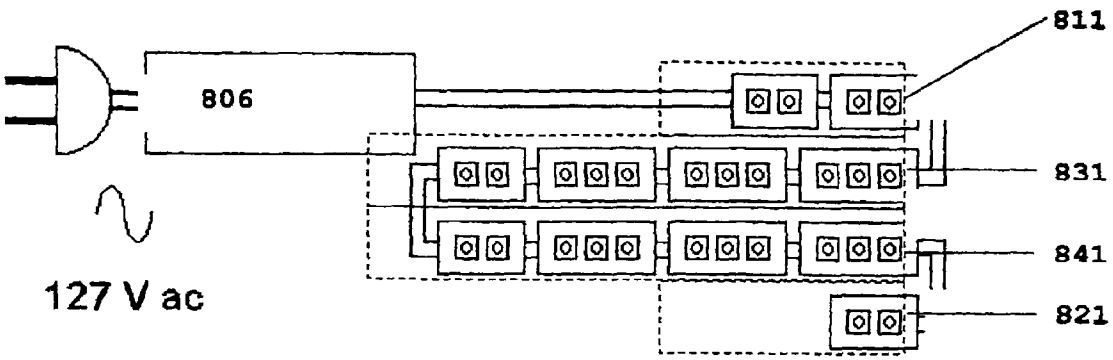
Figura 8d

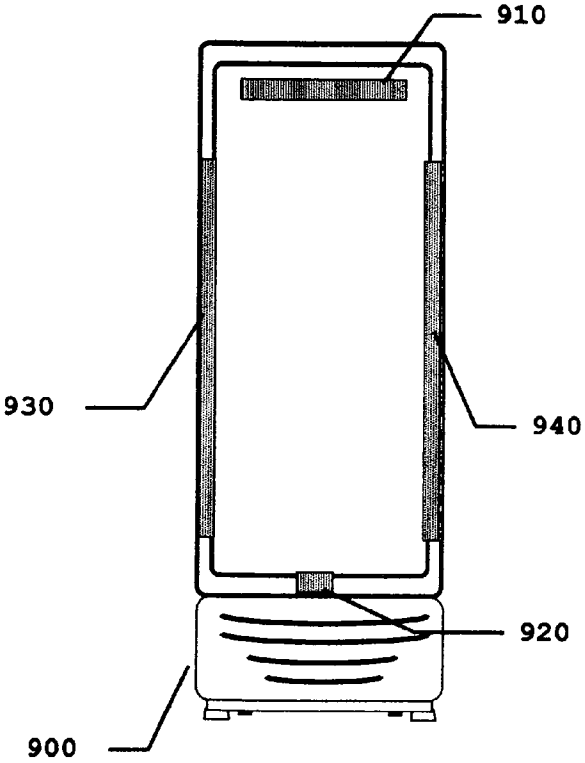
Figura 9a

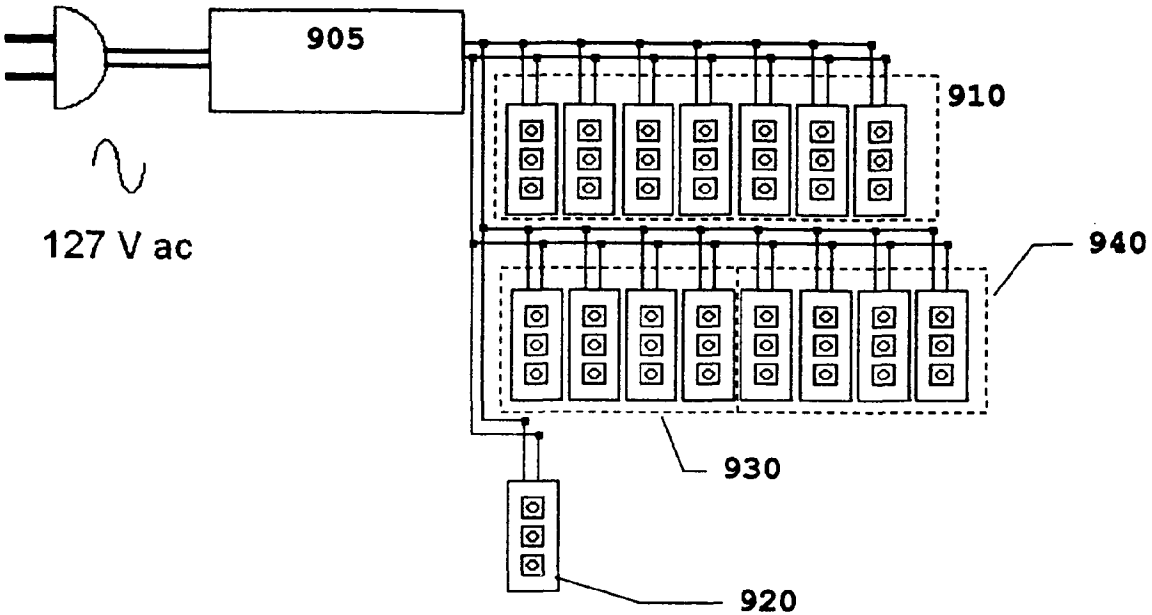
Figura 9b

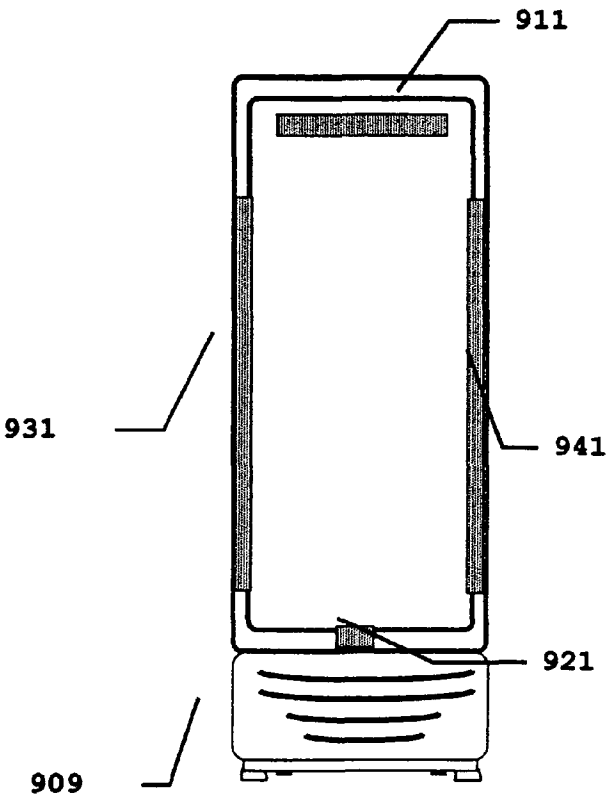
Figura 9c

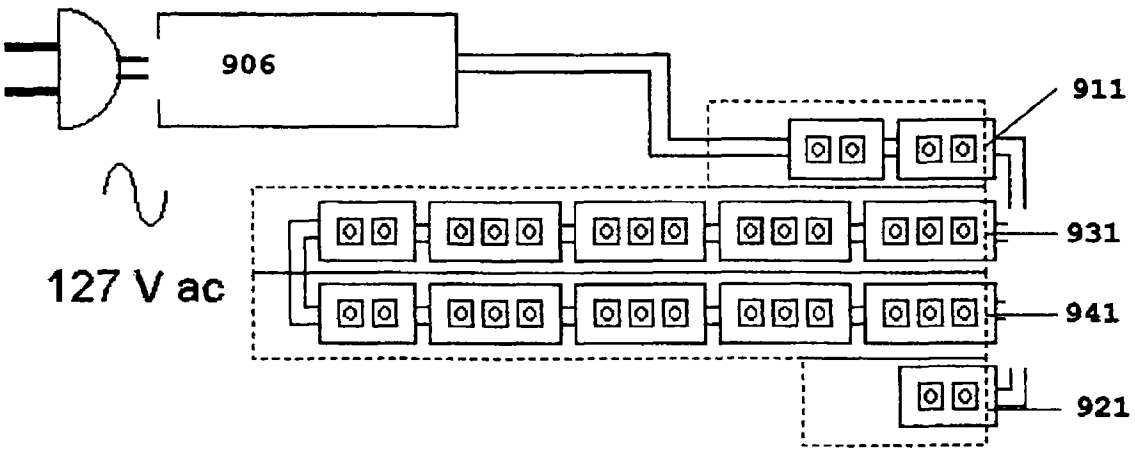
Figura 9d

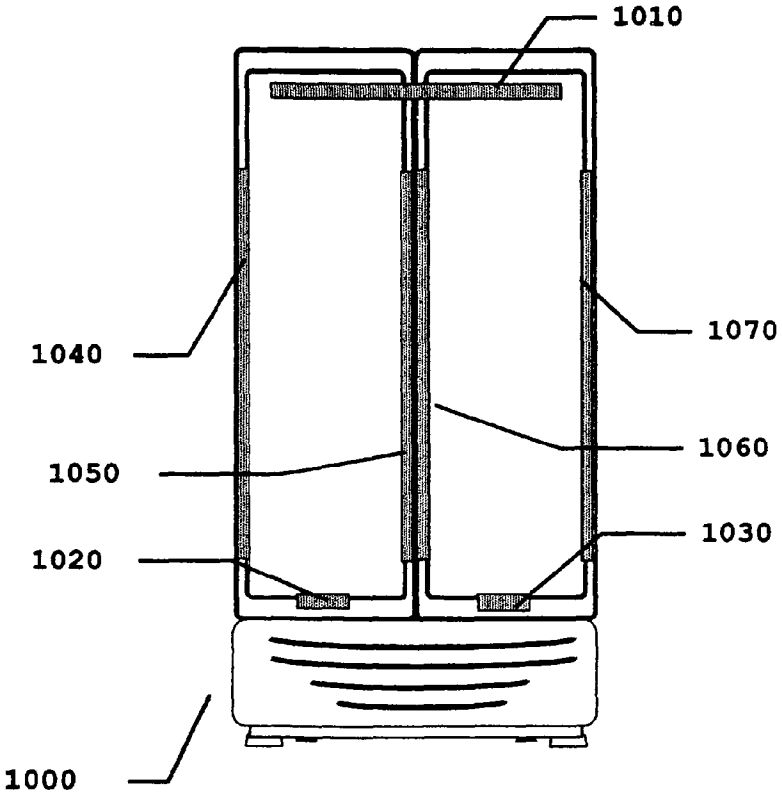
Figura 10a

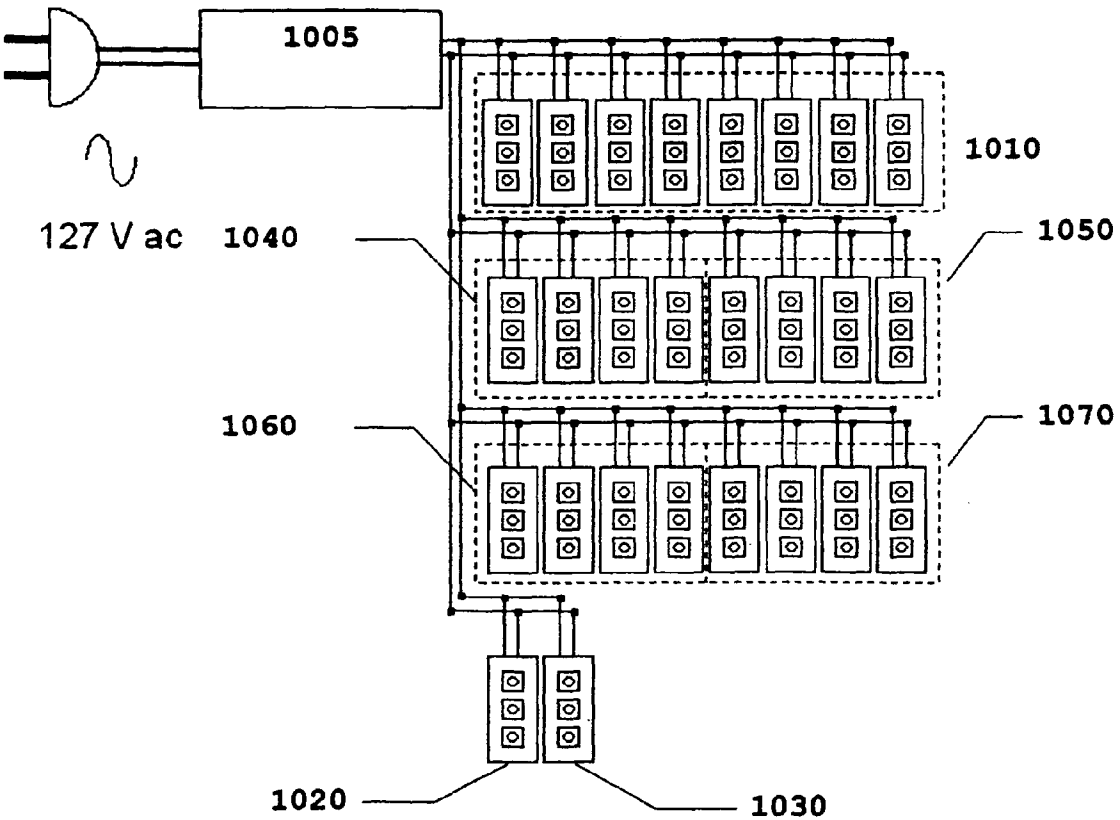
Figura 10b

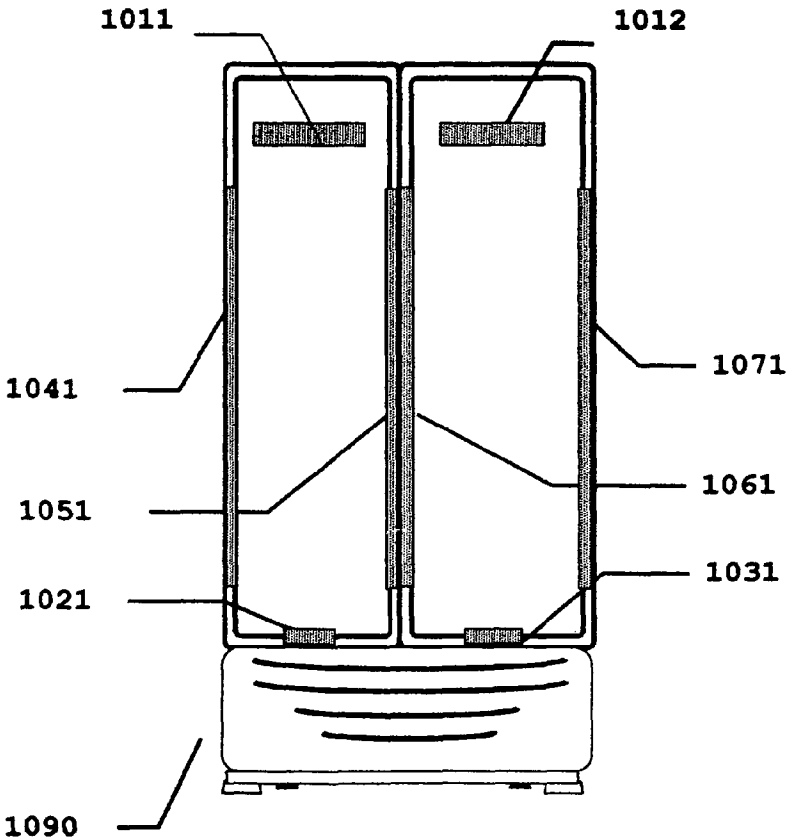
Figura 10c

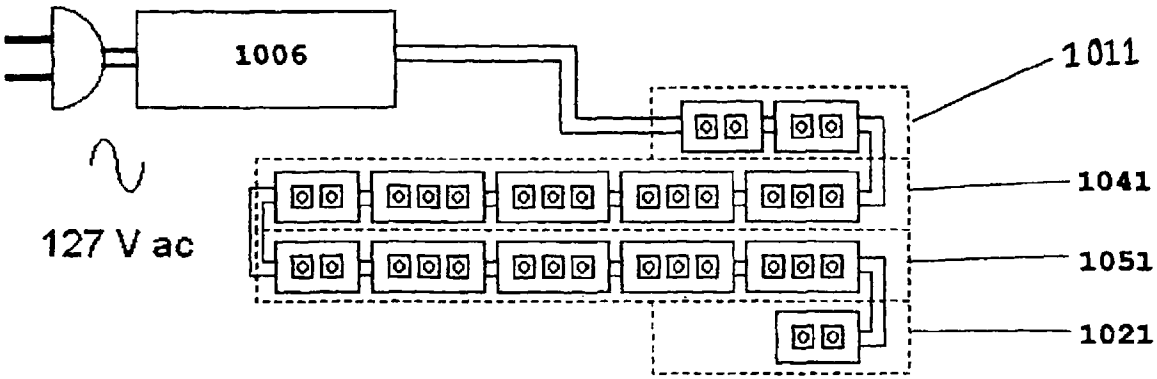
Figura 10d

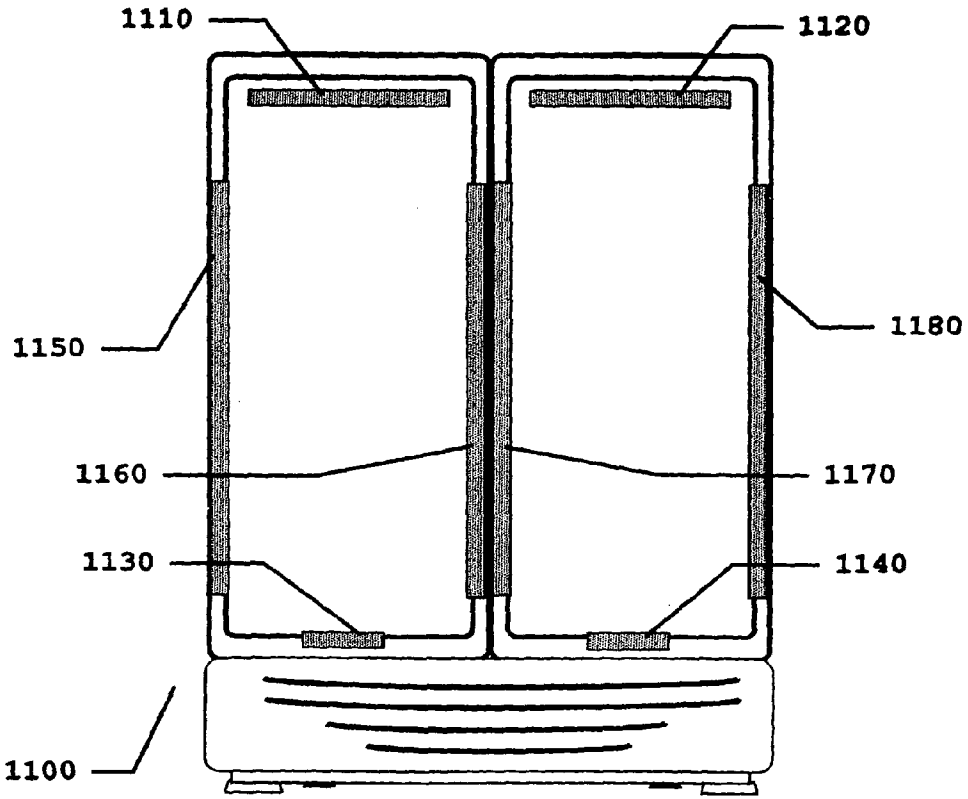
Figura 11a

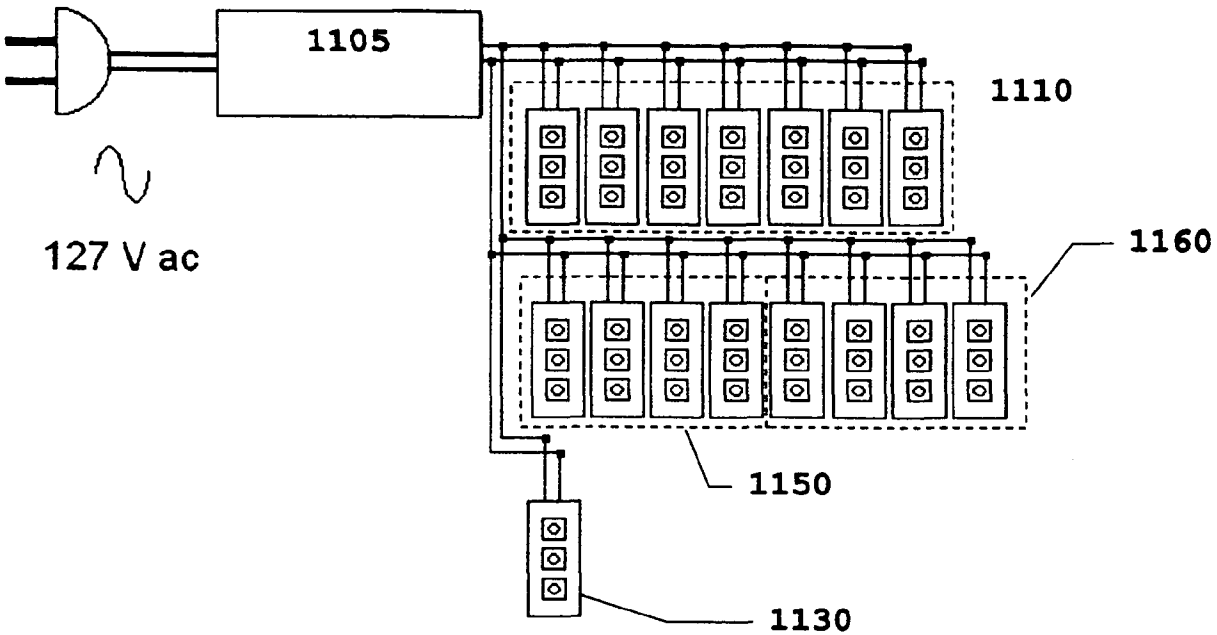
Figura 11b

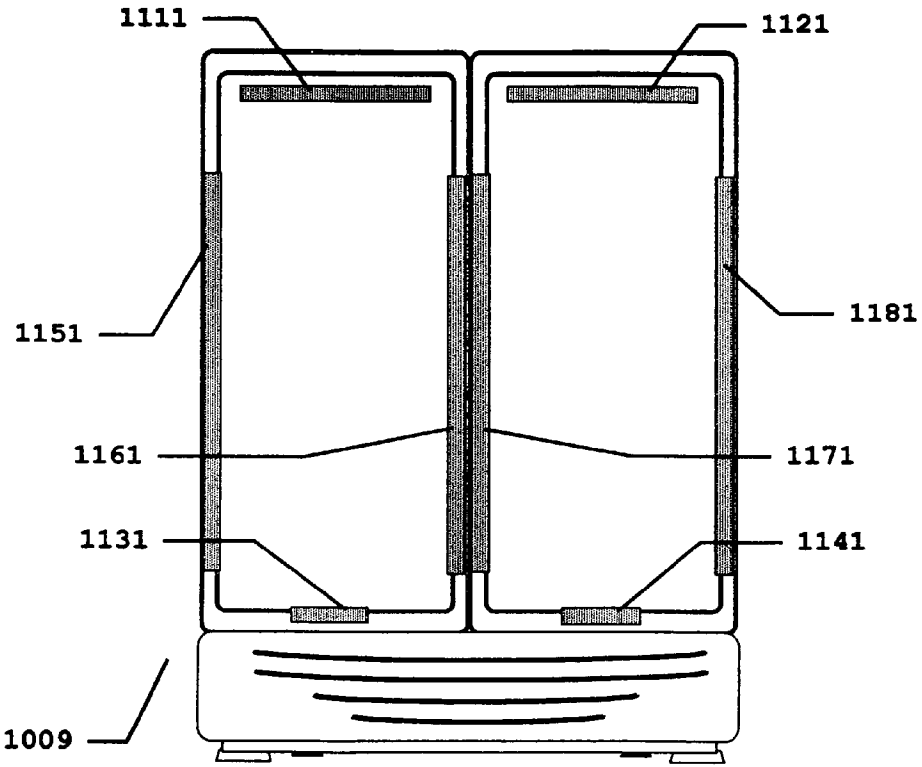
Figura 11c

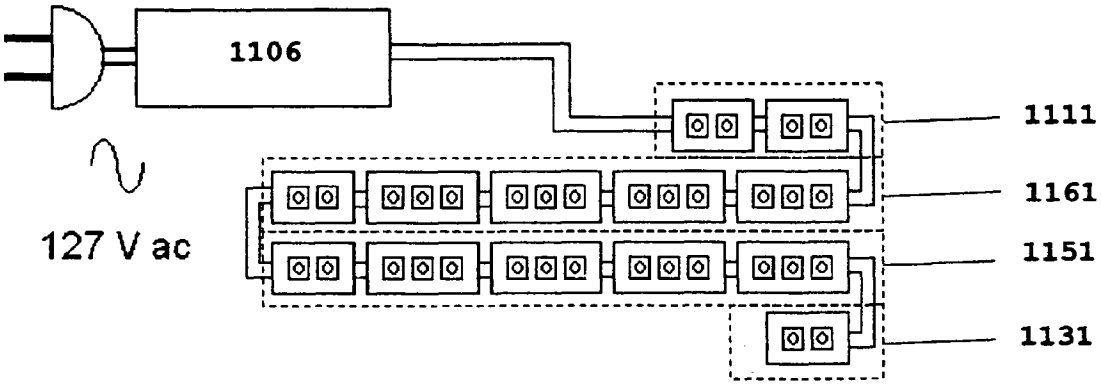
Figura 11d

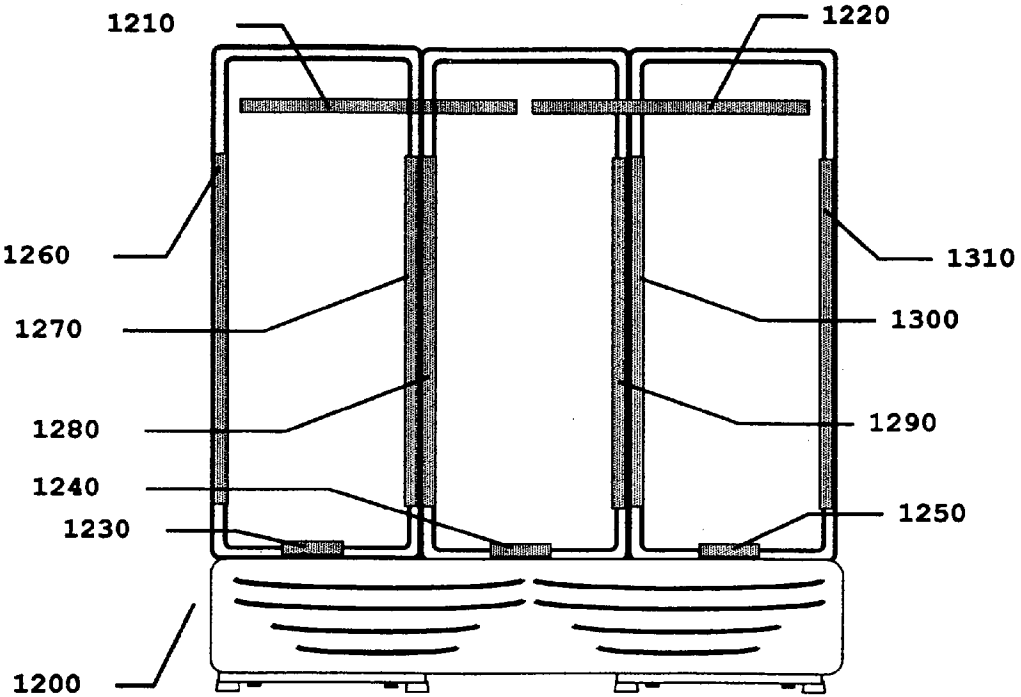
Figura 12a

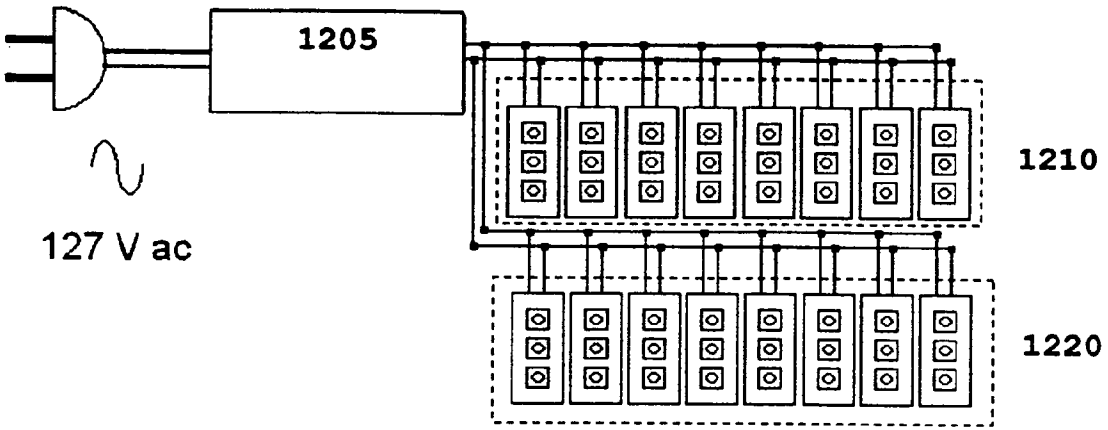
Figura 12b

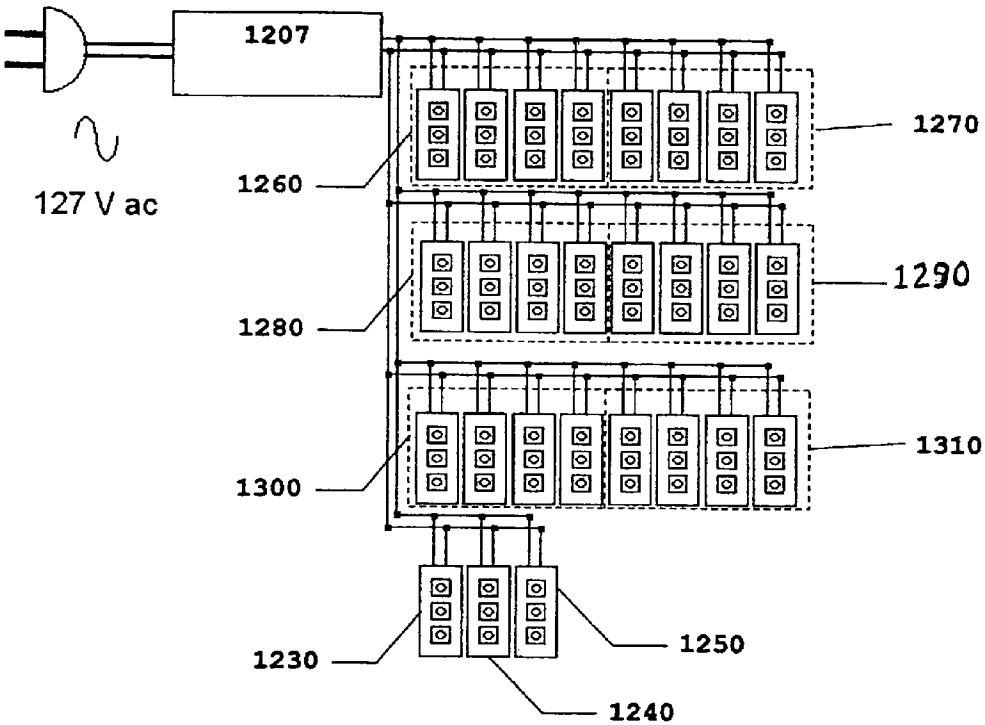
Figura 12c

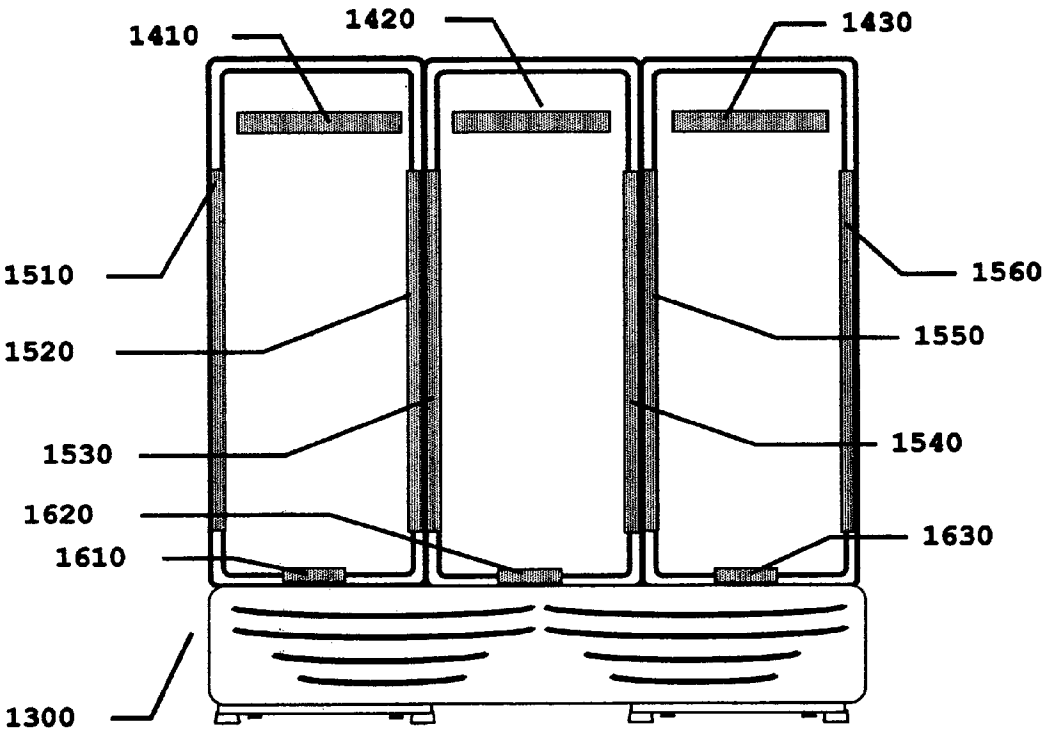
Figura 13a

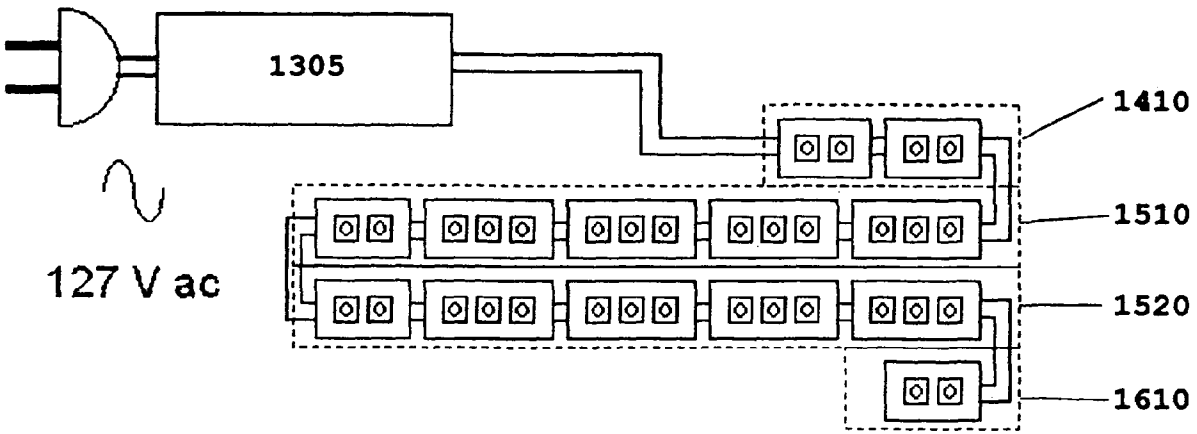
Figura 13b

SYSTEM FOR LIGHTING REFRIGERATION CABINETS USING LED LIGHTS

FIELD OF THE INVENTION

The invention relates to systems for lighting the interior of cabinets, such as refrigerators, and it is specially intended for one of said systems which uses LED lights as a lighting source, and where said LED lights are located at the inner periphery of the glass doors of commercial-type refrigerators or coolers, and whose characteristics allow an optimized lighting of items in the interior of the cabinet.

BACKGROUND

In the commercial environment of perishable food products, the refrigeration or cooling cabinets are well known, especially the ones having transparent front doors allowing products in the interior to be seen. However, it is necessary to have a lighting system in the interior of the cabinet in order to improve the display of items.

Nowadays, fluorescence lamps are used which are mounted on the door or at the inner side of the cabinet in a vertical manner or at the top of the cabinet in a horizontal manner in order to light the item to be displayed. An example of said system is described in the U.S. Pat. No. 5,937,666 (Trulaske, Sr., 1999), where a lighting system comprised by fluorescence lamps is disposed adjacent to the frame spar of the doors, in the interior side, being hidden from view from the exterior side; a support base is used and having open ends and running along said spar, two connecting elements for the lighting element located at the ends and including in some embodiments, a diffuser surrounding the fluorescent tube. Being the lamp vertically mounted on the door or laterally mounted on the side of the cabinet, the item located at the front up to the middle part is lightened so the rest of the items remain unlighted. Another example of a similar application is described in the U.S. Pat. No. 6,406,108 (Upton et al, 2002), which also uses fluorescent light tubes enclosed in a channel designed so in turn it is located in the door frame of the refrigeration cabinet.

In the lighting systems available nowadays, bigger lateral luminaries are placed in one or both sides of the interior of the cooler. Also, luminaries are disposed vertically on the door in order to light most of the item. Additional fluorescence lamps may be used in order to best display the item, holding horizontal lamps along the crossing sections of the door frames. However, by doing this, the power consumption increases since there are more luminaries, and so the heat issued increases as well, and a very short lifetime of the fluorescent luminary is maintained as well as the light drop due to low temperatures at the interior of the cooler. Likewise, high costs for services due to failures in the lighting system are maintained. Besides, when the fluorescence lamp is found at the top side of the cabinet, there is the problem that only the acrylic display and the first grid of the item is being lightened, and thus the remaining grids and the remaining items located at the middle part and up to the bottom part remain unlighted and unseen properly.

An important problem related to lighting an item is high costs of maintenance of equipments due to failures in the components of the lighting systems. A fluorescent luminary has a lifetime of about 9,000-13,000 hrs, this means 1 year or a bit more, pursuant to which the luminary or ballast are commonly replaced every year and costs for service are quite high. Moreover, fluorescent luminaries are very sensitive to room temperature. The light peak is reached in a fluorescent luminary at 30° C. but it quickly drops when temperature ranges on both sides, whether at high or low temperature. With low temperatures, fluorescence lamps have a light drop of 20% operating at a temperature of 7° C. and if temperatures are lower then it will drop even more. In addition, due to the configuration of the fluorescence lamps, only 60% of the light is used to light the cabinet, the rest goes outside the cabinet. Fluorescence lamps contribute to add heat obtained inside the cooler, thus diminishing the efficiency of the cooling system. Less of 25% of the total power consumed by a fluorescence lamp is turned into light, the remaining power is turned into heat. More than a half of the radiated heat-type heat is absorbed by the item located at the interior of the cooler. In addition, heat generated by fluorescent luminaries contributes to the uneven distribution of temperatures at the interior of the cabinet. ("Solid-State Lighting for refrigerated Display cases", pages 64-67, New technologies in Commercial Refrigeration, University of Illinois at Urbana-Champaign, P. S. Hrnjak Editor, Jul. 22 and 23, 2002).

In order to overcome problems pertinent to the use of fluorescence lamps, it was suggested to replace this lighting source for sets of LED lights (light emitting diodes), as illustrated, for example, in the U.S. Pat. No. 6,726,341 (Pashley et al, 2004) which describes a storage compartment equipped with a lighting source based on LEDs positioned so preferably the interior of the cabinet is lightened; the U.S. Pat. No. 7,121,675 (Ter-Hovhannisaian, 2006) describes, in turn, a lighting system for environments of low temperature including a plurality of light emitting diodes subject to a support member mounted inside a refrigeration unit, the system includes a reflector close to the LEDs in order to spread emitted light, like a light transmitting cover which covers the LEDs, where said cover includes non-planar surfaces to spread light over the items at the interior of the cabinet. The system is intended to be mounted on the spar of the door frame or otherwise, preferably, on the inner trays of the cabinet, so lighting of items is optimized.

In this last patent, arrangements of LEDs mounted on the support members are described so arrangements over a circuit board are formed and sealed. Arrangements are linear and the reflector is distributed along said linear arrangements of LEDs. Arrangements may be constructed of any length or configuration required for a particular application, they are preferred to be embodied in multiple lighting units electrically interconnected with each other, being said lighting units of a length of only 90 cm, and if interconnection can be achieved by means of a wiring, the use of caps including electrical connectors subject to the ends of each unit is desirable, connectors being female and male connectors. Lighting units, even though they are found interconnected, maintain an independent operation so if one of the units is not operable due to failures, it does not alter the operation of the other units The U.S. Pat. No. 6,283,612 (Hunter, 2001) describes a strip of LEDs that is kept in the interior of a tube that seems to be a fluorescence lamp; the tube contains a printed circuit board with a positive bus and one negative bus extending along the entire card; resistors are included in contact with the positive bus in one end and a set of LEDs on the other end, LEDs are mounted through holes in the card and the anode of the diode is in communication with a resistor whilst the cathode of the diode gets into contact with the anode of diode adjacent connecting each other in shorts sets at the base of the circuit. The final cathode of each set is coupled to the negative bus forming a predetermined group of diodes electrically coupled to a single resistor in one end and the negative bus in the other end. The assembly in the tube is enclosed by two caps at the ends and an electric wire is connected through the caps to the buses of the printed circuit. A power source gets in contact, by means of the wire, with the circuit, providing low voltage direct current to a predetermined group of LEDs in order to light the area surrounding said strip.

By using the tube of LEDs similar to the fluorescent tube is possible then to have a luminary with long lifetime but the problem of uniform lighting is not solved in the entire item to be displayed. For example, the U.S. Pat. No. 6,550,269 (Rudick, 2003) describes a lighting system for the interior of refrigeration cabinets and dispensing products, such as vending machines, coolers, etc., based on directional LEDs positioned so they can light the best possible way the items located closer to the lighting source, that is, those in the front of the cabinet, towards the glass door/window. The directivity of LEDs used is about 20° with a lighting intensity from 5 to 6 candles and a brightness of 1000 to 3000 lumens. Directional LEDs are located over trays, at the door frame and/or in mounting blocks, and may be intended for specific parts of the product, being adjustable. In one example of the invention, it is mentioned the LEDs may be grouped with the shape of a tube, with a diameter of 19 to 32 mm and a length between 30 and 90 cm; each group may contain between 18 and 54 LEDs. However, the invention emphasizes the direction of the lighting with the purpose of stressing specific sections of the product; the lighting of the interior of the cabinet is completed by the use of alternate light sources.

In this sense, some efforts have been focused on the distribution of light emitted from the source selected. Some examples regarding this issue are as follows:

The U.S. Pat. No. 5,471,372 (Mamelson et al, 1995) described a lighting system for a refrigeration cabinet lighted by fluorescence lamp located closer and behind the glass of the doors. Each lamp has a reflector associated and located enclosed at least partially by plastic lens having multiple facets at the interior face. The reflector and the lens cause the light emitted by the lamp is reflected and refracted such that the light is substantially uniform-distributed over the products located at several distances from the lamp and reduce the reflection of the immediate proximity of the lamp.

The U.S. Pat. No. 6,578,979 (Truttmann-Battig, 2003) on the other hand, describes a lighting system based on LEDs comprised in modules consisting of a plastic receptacle with a ground plate where there are carrying networks defining sloped surfaces over which strips of printed circuit with LEDs are placed. LEDs have a projection angle ($\beta$) and where this angle corresponds preferably to the tilt angle between the sets of LEDs ($\alpha$), in this way the radiation angles of several parallel arrangements of LEDs cover a wider area of a single strip. The set of LEDs thus comprised is fixed to the interior of the plastic receptacle having a section in "U", and the open face is covered by a transparent and curved sheet; in this way the lighting angle achieved with the arrangement is best used, being limited, however, by the walls of the plastic receptacle towards the forward direction.

In light of the limitations and problems at the developments thus far suggested in the prior art, it is an object of this invention, to provide an efficient system of lighting for commercial refrigerators and coolers with glass doors, allowing proper lighting and therefore displaying products at the interior of the cabinet.

It is another object of this invention to provide a lighting system for the interior of low maintenance cost cabinets.

It is another object of this invention to provide a lighting system for the interior of the cabinets with an improved diffusion of light emitted regarding known systems, so this allows a uniform lighting of items at the interior of the cabinet.

It is still another object of this invention to provide a lighting system for the interior of the cabinets where the lighting system provides a lighting angle wider than the one of conventional systems.

These and other objects and advantages of this invention will be apparent in light of the description below, which is attached with a set of figures for preferred embodiments of the invention and it will be understood that they are made for illustrative and not limitative purposes of the teachings of the invention.

SUMMARY

This invention refers then to a lighting system including a novel design of luminary to be used specially in cabinets of coolers and refrigerators, based on LEDs as a light source.

Problems associated to the emission of heat by the use of fluorescence lamps in the systems nowadays on the market, have been solved in this invention through the use of sets of LEDs comprised in luminaries, which can be connected to each other in order to form the lighting system of the invention.

The expected lifetime of a LED is 100,000 hrs compared to the 10,000 to 13,000 hrs of a fluorescent luminary, with a minimum heat input, from the order of 33-35 Mw. Due to the size, LEDs of this invention are mounted on a PCB (Printed Circuit Board) and fixed on a diffusion tube adjusted to the periphery of the door allowing thus a uniform lighting of the entire product to be displayed.

BRIEF DESCRIPTION OF THE DRAWINGS

For a better understanding of the advantages of the device of the invention, a set of drawings and figures is now presented which is intended to illustratively show the characteristics of the device and the mode to use it without being limitative.

FIG. 1*a* is a schematic view of a preferred embodiment of an individual lighting module with a set of 3 LEDs.

FIG. 1*b* is a diagram of supplying to modules of LEDs by groups of 3 pieces.

FIG. 2*a* is a schematic view of a preferred embodiment of the current supply circuit (driver) for an arrangement of 6 or 7 LEDs.

FIG. 2*b* is a schematic view of a preferred embodiment of a driver for 17 LEDs.

FIG. 2*c* is a schematic view of a preferred embodiment of a driver for 22 LEDs.

FIG. 2*d* is a schematic view of a preferred embodiment of a driver for 28 LEDs.

FIG. 2*e* is a schematic view of a preferred embodiment of a driver for 34 LEDs.

FIG. 3*a* is a perspective view of a section of the diffusion tube of the invention.

FIG. 3*b* is a side view of a section of the diffusion tube of the invention, showing the PCB with a set of LEDs at the interior.

FIG. 3*c* is a front, plan view of an alternative embodiment of the diffusion tube of the invention.

FIG. 4 is a perspective view of a hermetic cap of the diffuser, located in one end therein, showing connectors for the installation of the system.

FIG. 5 is a schematic, plan, upper view of the set of sections for the door frame, diffuser and support of the diffuser that are part of the lighting system of the invention.

FIG. 6 is a schematic view of the connections between luminaries to comprise the lighting system of the invention.

FIG. 7*a* is a schematic view of the preferred distribution of lighting elements of the system of this invention at a door of a first type of conventional commercial cooler or refrigerator.

FIG. 7*b* is a schematic view of the serial-parallel connection between the elements of the lighting system at the cooler of the FIG. 7*a*.

FIG. 7*c* is a schematic view of the preferred distribution of lighting elements of the system of this invention at a door of a first type of conventional commercial cooler or refrigerator.

FIG. 7*d* is a schematic view of the serial connection between the elements of the lighting system at the cooler of the FIG. 7*c*.

FIG. 8*a* is a schematic view of the preferred distribution of lighting elements of the system of this invention at a door of a second type of conventional commercial cooler or refrigerator.

FIG. 8*b* is a schematic view of the serial-parallel connection between the elements of the lighting system at the cooler of the FIG. 8*a*.

FIG. 8*c* is a schematic view of the preferred distribution of lighting elements of the system of this invention at a door of a second type of conventional commercial cooler or refrigerator.

FIG. 8*d* is a schematic view of the serial connection between the elements of the lighting system at the cooler of the FIG. 8*c*.

FIG. 9*a* is a schematic view of the preferred distribution of lighting elements of the system of this invention at a door of a third type of conventional commercial cooler or refrigerator.

FIG. 9*b* is a schematic view of the serial-parallel connection between the elements of the lighting system at the cooler of the FIG. 9*a*.

FIG. 9*c* is a schematic view of the preferred distribution of lighting elements of the system of this invention at a door of a third type of conventional commercial cooler or refrigerator.

FIG. 9*d* is a schematic view of the serial connection between the elements of the lighting system at the cooler of the FIG. 9*c*.

FIG. 10*a* is a schematic view of the preferred distribution of lighting elements of the system of this invention at a door of a fourth type of conventional commercial cooler or refrigerator.

FIG. 10*b* is a schematic view of the serial-parallel connection between the elements of the lighting system at the cooler of the FIG. 10*a*.

FIG. 10*c* is a schematic view of the preferred distribution of lighting elements of the system of this invention at a door of a fourth type of conventional commercial cooler or refrigerator.

FIG. 10*d* is a schematic view of the serial connection between the elements of the lighting system at the cooler of the FIG. 10*c*.

FIG. 11*a* is a schematic view of the preferred distribution of lighting elements of the system of this invention at a door of a fifth type of conventional commercial cooler or refrigerator.

FIG. 11*b* is a schematic view of the serial-parallel connection between the elements of the lighting system at the cooler of the FIG. 11*a*, for one of the doors.

FIG. 11*c* is a schematic view of the preferred distribution of lighting elements of the system of this invention at a door of a fifth type of conventional commercial cooler or refrigerator.

FIG. 11*d* is a schematic view of the serial connection between the elements of the lighting system at the cooler of the FIG. 11*c*, for one of the doors.

FIG. 12*a* is a schematic view of the preferred distribution of lighting elements of the system of this invention at a door of a sixth type of conventional commercial cooler or refrigerator.

FIG. 12*b* is a schematic view of the serial-parallel connection between the elements of the lighting system that light the heading of the cooler of the FIG. 12*a*.

FIG. 12*c* is a schematic view of the serial-parallel connection between the elements of the lighting system that light the side and bottom zone of the cooler of the FIG. 12*a*.

FIG. 13*a* is a schematic view of the preferred distribution of lighting elements of the system of this invention at a door of a sixth type of conventional commercial cooler or refrigerator.

FIG. 13*b* is a schematic view of the serial connection between the elements of the lighting system that light the heading of the cooler of the FIG. 13*a*.

DETAILED DESCRIPTION

The following description will be referred to the attached drawings abovementioned, which should be understood as illustrative of the invention and not limitative of the scope therein. Common elements of figures have the same numeral references thereof.

It is well known in the art of using sets of LEDs as lighting sources in substitution of fluorescent tubes, with several advantages regarding quality of lighting, duration and maintenance cost, mainly. It is also known that there are problems that avoid the achievement of a complete lighting of the items displayed at the interior of the cabinets of conventional commercial refrigerators and coolers. This invention is focused to solve said problems, through the following improvements of the prior art.

Light Source

One of the problems in using light-emitting diodes is that LEDs emit an addressed and restricted light normally to narrow radiation angles. The LED used in the invention has a projection angle of 120°-180°, showing a high luminosity, from the order of 80 mA average, although the use of LEDs with higher or lesser intensity is possible, even this reduces the quality of the lighting. The LED used in the invention has a projection angle of 120°-180°, showing a high luminosity, from the order of 80 mA average, although the use of LEDs with higher or lesser intensity is possible, even this reduces the quality of the lighting.

TABLE 1

| Characteristics of the preferred LED for the system of the invention. |
|---|
| 1. HIGH LUMINOSITY LED WHITE MARBLE ("COLD") |
| 2. ENCAPSULATED: SUPERFLUX |
| 3. DISSIPATION ANGLE: HALF VALUE ANGLE (2 $^{a}$ ½) = 180° |
| 4. LUMINOUS FLUX: 3 Lm |
| 5. VOLTAGE: DIRECT CURRENT OF 3.5 V. |
| 6. AT A CONDITION OF 80 Ma |
| 7. DISSIPATION POWER: 350 mW |

LEDs are grouped in arrangements of 2 and 3 LEDs serial-connected, as schematically illustrated in FIG. 1*a*, or in a serial-parallel arrangement as shown in FIG. 1*b*.

With a configuration like that, there may be variable lengths by interconnecting modules and forming, for example, sets of 6, 17, 22, 28, and 34 LEDs, in order to adapt to the lighting needs according to the area size to be lightened. The second configuration, shown in FIG. 1*b*, in serial-parallel, allows ensuring the continuous operation of the light source even with the failure of any of the LEDs of the arrangement.

The serial connection illustrated in FIG. 1 is preferred over the parallel connection, mainly due to the higher efficiency of the first arrangement, since in a given set, a higher number of LEDs involves a higher voltage, thus the voltage drop, by turning on the set with a supply of 127 Vrms, is lesser and thus reducing losses in the correction step.

The use of serial-parallel connection of FIG. 1*b* is for protection of the circuit, if there is failure of a LED in the set, thus opening the circuit, the rest of the sets that are parallel-connected to the same driver will have an increase of current and since the driver is "blind", and in order to maintain the same current, the current is distributed between the other circuits. It is pretty clear that the increase of current may damage the rest of the circuits in cascade effect, finally damaging the entire sets.

Drivers

For the operation of LEDs, a direct current voltage-type supply is required, and in order to assure a uniform and constant lighting, as well as to protect the LEDs themselves, it is necessary to design a rectifier circuit (driver) with regulation of current. The regulation of current is the indicated to turn the LEDs on, since the total luminous flux a LED can emit is correlated to the IF current and not to the live biasing voltage (VF); the use of a regulator of current then guarantees a uniform luminosity between the LEDs of a group.

FIGS. 2*a* to 2*e* show preferred embodiments of drivers accurate for the system of the invention, regarding the number of LEDs in each sets. In order to reduce heat dissipated by the driver, an arrangement of parallel capacitors is used (referred as C1, C2, C3, C4) to create a capacitive reactance that limits the amount of current entered to the circuit. Subsequently, a current signal is rectified with a diode bridge (referred as D1, D, D3, D4) and finally one or two linear integrated circuits are used (referred as U1, U2) of preprogrammed current (through designated resistances by R1, R2, R3, etc.) to provide a constant quantity of current, from the order of 80 mA.

FIG. 2*a* schematically depicts the preferred driver for an embodiment of a lamp that includes 6 or 7 LEDs, where components have the meaning above-mentioned.

FIG. 2*b* schematically depicts the preferred driver for the embodiment of a lamp that includes 17 LEDs; FIG. 2*c* schematically depicts the preferred driver for the embodiment of a lamp that includes 22 LEDs; FIG. 2*d* schematically depicts the preferred driver for the embodiment of a lamp that includes 28 LEDs; and the FIG. 2*e* schematically depicts the preferred driver for the embodiment of a lamp that includes 34 LEDs.

The designs of the drivers shown herein operate at 80 mA in the output and a range of operation of alternate current of 90-230v, and the voltage output is provided based on the number of LEDs.

Electronic components of the driver are contained on a printed circuit protected in an injected plastic cabinet subsequently filled with resin, so the module remains protected against the environment.

Uniformity of Lighting

Despite the wide radiation angle of the LED used in the system of the invention, this tends to emit a prompt light, so the lamp is integrated at the interior of the tube (300) shown in FIG. 3*a*, with diffusion lines (310) so the light may be more diffused and with better quality of lightening, the opening angle is opened and a LED (320) is protected from humidity. The diffusion tube (300) is made of a plastic material resistant to temperature and physical deformation, being preferably made of polycarbonate. It can be seen from FIG. 3*c*, an alternative embodiment of the diffusion tube (300') that the diffusion tube may amend its configuration whenever this affects the lighting angle.

The set of LEDs (320) mounted on the PCB (330) is inserted and adjusted on the interior edges of the diffusion (300) tube, as schematically illustrated in FIG. 3*b*. Arranged in this manner, the diffusion tube altogether with the PCB serves as a heat dissipation means.

Assembly of Lighting Modules (Luminaries)

Once they are placed in situ within the diffusion tube (300), the PBC (330) with the set of LEDs (320), the diffusion tube (330) is sealed in the ends by the use of rubber caps being adjusted and subject in situ by conventional media, such as, for example, adhesive, as illustrated in FIG. 4. Caps (400) support electric connectors (410) necessary to provide current to the LEDs, and cables of said connectors go through the cap to connect to the respective buses.

Preferably, LEDs (320) are protected from humidity of the environment by means of a silicone, such as GE seal proof SCS 2000, applied to the tips of the tubes (330) to then place the plastic caps (400), thus sealing the tubes. Moreover, a desiccant Tape Multisorb Technologies Inc. is also used to absorb possible humidity found at the interior of the tube or by means of condensation by being at the tube subject to changes of temperatures.

Assembly of the System in the Cabinet

The set thus formed is hermetic in order to protect the LEDs from environmental humidity, and for fixation at the interior of the door frame of a refrigeration cabinet, a support section (510) or "molding" has been designed, schematically shown in FIG. 5, that in turn adapts to the section (500) of the door frame; this new set of assembly is completed by a magnetic seal (520).

FIG. 6 schematically illustrates the interconnection between several lighting modules (600) in accordance with the above described to comprise a lighting system according to this invention. The way to join the modules (600) of PCB with LED is through Header type connectors with part number TSW-102-08-T-S-R-A and female Terminal with part number SSW-102-T-S-RA edge-type at 180 in order to avoid disconnection once they are into the tube. Moreover, a shrinkable heat is placed in order to ensure connectivity as the time goes by and avoid disconnections.

The optimal distribution of the modules of LEDs in several types of coolers has been analyzed and the results are described as examples of application related to the FIGS. 7*a*-13*b*, where modules of LEDs or luminaries (600) are appreciated to be located preferably at the periphery of the door (700) in order to have de uniform distribution to light the entire product to be displayed. It is appreciated from Figures that it is possible to combine modules (600) from several lengths so the lighting is more efficient, being recommended the use of, for example, shorter lamps for the bottom zone of the door rather than the upper zone, and the use of long modules for vertical spars. Details are attached in each example.

Example 1

The lighting system preferred for a commercial cooler of a short-height single door (700), illustrated in FIG. 7*a* includes a luminary (or module) for lightening the heading (710), another one for the bottom zone (720) and two for the sides of the door (730), (740). For this lighting system an arrangement is used as the one shown in FIG. 1*b* in serial-parallel; that is, each module comprises 3 LED serial-connected and each module in turn, is parallel-interconnected with other modules of 3 LEDs, thus allowing the continuous operation of the light source even when with the failure of some of the LEDs of the arrangement. The number of LEDs and its distribution are described in Table 2:

TABLE 2

Amount and distribution of LEDs in a system for a cooler with a short-height single door.

| Luminary | LEDs |
|---|---|
| Heading (710) luminary | 21 |
| Side (730), (740) luminary | 12 (6 in each side) |
| Bottom (730) luminary | 3 |
| Total | 36 |

FIG. 7*b* schematically depicts the elements and connections between them, illustrating the driver (705) and the connections for the heading (710) luminary with 7 sets of 3 LEDs, the side (730), (740) luminaries with 2 blocks of 3 LEDs each one, and the bottom (720) luminary with 1 set of 3 LEDs. The specifications of the driver and the characteristics of the LEDs for an arrangement like this are shown in Tables 3 and 4.

TABLE 3

Specifications of the driver for a system for a cooler with a middle-height door.

| | Minimum | Maximum | Unit |
|---|---|---|---|
| Input current (RMS) | | | Amp |
| Input voltage (RMS) | 108 | 132 | V |
| Output voltage | 10 | 11 | V |
| Output current | 0.960 | 2.38 | Amp |
| Output power | 9.6 | 25 | Watt |

TABLE 4

Characteristics of LEDs for a system for a cooler with a middle-height door.

| | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 2

The lighting system preferred for a commercial cooler of a short-height single door (709), illustrated in FIG. 7*c* includes a luminary (or module) for lightening the heading (711), another one for the bottom zone (721) and two for the sides of the door (731), (741). For this lighting system an arrangement is used as the one shown in FIG. 1*a*. LEDs are grouped in arrangements of 2 and 3 LEDs, serial-connected, as schematically illustrated in FIG. 1*a*. The number of LEDs and its distribution are described in Table 5:

TABLE 5

Amount and distribution of LEDs in a system for a cooler with a short-height single door.

| Luminary | LEDs |
|---|---|
| Heading (711) luminary | 4 |
| Side (731), (741) luminaries | 16 (8 in each side) |
| Bottom (721) luminary | 2 |
| Total | 22 |

FIG. 7*d* schematically depicts the elements and connections between them, illustrating the driver (706) and the connections for the heading (710) luminary with 2 modules of 2 LEDs, the side (731), (741) luminaries with 2 modules of 3 LEDs and 1 module of 2 LEDs each one, and the bottom (721) luminary with 1 module of 2 LEDs. The specifications of the driver and the characteristics of the LEDs for an arrangement like this are shown in Tables 6 and 7.

TABLE 6

Specifications of the driver for a system for a cooler with a middle-height door.

| | Minimum | Maximum | Unit |
|---|---|---|---|
| Input current (RMS) | 0.050 | 0.065 | Amp |
| Input voltage (RMS) | 108 | 132 | V |
| Output voltage | 61.6 | 70.4 | V |
| Output current | 0.075 | 0.105 | Amp |
| Output power | 4.62 | 7.392 | Watt |

TABLE 7

Characteristics of LEDs for a system for a cooler with a middle-height door.

| | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 3

The lighting system preferred for a commercial cooler of a middle-height single door (800), illustrated in FIG. 8*a* includes a luminary for lightening the heading (810), another one for the bottom zone (820) and two for the sides of the door (830), (840). For this lighting system an arrangement is used as the one shown in FIG. 1*b* in serial-parallel; that is, each module comprises 3 LED serial-connected and each module, in turn, is parallel-interconnected with other modules of 3 LEDs, thus allowing the continuous operation of the light source even when with the failure of some of the LEDs of the arrangement. The number of LEDs and its distribution are described in Table 8:

TABLE 8

Amount and distribution of LEDs in a system for a cooler with a middle-height single door.

| Luminary | LEDs |
|---|---|
| Heading (810) luminary | 21 |
| Side (830), (840) luminaries | 18 (9 in each side) |
| Bottom (830) luminary | 3 |
| Total | 42 |

FIG. 8*b* schematically depicts the elements and connections between them, illustrating the driver (805) and the connections for the heading (810) luminary with 7 sets of 3 LEDs, the side (830), (840) luminaries with 3 blocks of 3 LEDs each one, and the bottom (820) luminary with 1 set of 3 LEDs. The specifications of the driver and the characteristics of the LEDs for an arrangement like this are shown in Tables 9 and 10.

TABLE 9

Specifications of the driver for a system for a cooler with a middle-height door.

| | Minimum | Maximum | Unit |
|---|---|---|---|
| Input current (RMS) | | | Amp |
| Input voltage (RMS) | 108 | 132 | V |
| Output voltage | 10 | 11 | V |
| Output current | 1.120 | 2.38 | Amp |
| Output power | 11.2 | 25 | Watt |

TABLE 10

Characteristics of LEDs for a system for a cooler with a middle-height door.

| | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 4

The lighting system preferred for a commercial cooler of a middle-height single door (809), illustrated in FIG. 8*c* includes a luminary for lightening the heading (811), another one for the bottom zone (821) and two for the sides of the door (831), (841). For this lighting system an arrangement is used as the one shown in FIG. 1*a*. LEDs are grouped in arrangements of 2 and 3 LEDs, serial-connected, as schematically illustrated in FIG. 1*a*. The number of LEDs and its distribution are described in Table 11:

TABLE 11

Amount and distribution of LEDs in a system for a cooler with a middle-height single door.

| Luminary | LEDs |
|---|---|
| Heading (811) luminary | 4 |
| Side (831), (841) luminaries | 22 (11 in each side) |
| Bottom (821) luminary | 2 |
| Total | 28 |

FIG. 8*d* schematically depicts the elements and connections between them, illustrating the driver (806) and the connections for the heading (811) luminary with 2 modules of 2 LEDs, the side (831), (841) luminaries with 3 modules of 3 LEDs and 1 module of 2 LEDs each one, and the bottom (821) luminary with only 1 module of 2 LEDs. The specifications of the driver and the characteristics of the LEDs for an arrangement like this are shown in Tables 12 and 13.

TABLE 12

Specifications of the driver for a system for a cooler with a middle-height door.

| | Minimum | Maximum | Unit |
|---|---|---|---|
| Input current (RMS) | 0.064 | .083 | Amp |
| Input voltage (RMS) | 108 | 132 | V |
| Output voltage | 78.4 | 89.6 | V |
| Output current | 0.075 | 0.105 | Amp |
| Output power | 5.88 | 9.408 | Watt |

TABLE 13

Characteristics of LEDs for a system for a cooler with a middle-height door.

| | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 5

The lighting system preferred for a commercial cooler of a total-height single door (900), illustrated in Figure 0.22 acres includes a luminary (or module) for lightening the heading (910), another one for the bottom zone (920) and two for the sides of the door (930), (940). For this lighting system an arrangement is used as the one shown in FIG. 1*b* in serial-parallel; that is, each module comprises 3 LED serial-connected and each module, in turn, is parallel-interconnected with other modules of 3 LEDs, thus allowing the continuous operation of the light source even when with the failure of some of the LEDs of the arrangement. The number of LEDs and its distribution are described in Table 14:

TABLE 14

Amount and distribution of LEDs in a system for a cooler with a total-height single door.

| Luminary | LEDs |
|---|---|
| Heading (810) luminary | 21 |
| Side (830), (840) luminaries | 24 (12 in each side) |
| Bottom (830) luminary | 3 |
| Total | 48 |

FIG. 9*b* schematically depicts the elements and connections between them, illustrating the driver (905) and the connections for the heading (910) luminary with 7 sets of 3 LEDs, the side (930), (940) luminaries with 4 blocks of 3 LEDs each one, and the bottom (920) luminary with 1 set of 3 LEDs. The specifications of the driver and the characteristics of the LEDs for an arrangement like this are shown in Tables 15 and 16.

TABLE 15

| Specifications of the driver for a system for a cooler with a total-height door. | | | |
|---|---|---|---|
| | Minimum | Maximum | Unit |
| Input current (RMS) | | | Amp |
| Input voltage (RMS) | 108 | 132 | V |
| Output voltage | 10 | 11 | V |
| Output current | 1.28 | 2.38 | Amp |
| Output power | 1.28 | 25 | Watt |

TABLE 16

| Characteristics of LEDs for a system for a cooler with a middle-height door. | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 6

The lighting system preferred for a commercial cooler of a total-height single door (909), illustrated in Figure 0.22 acres includes a luminary (or module) for lightening the heading (911), another one for the bottom zone (921) and two for the sides of the door (931), (941). For this lighting system an arrangement is used as the one shown in FIG. 1*a*. LEDs are grouped in arrangements of 2 and 3 LEDs, serial-connected, as schematically illustrated in FIG. 1*a*. The number of LEDs and its distribution are described in Table 17:

TABLE 17

| Amount and distribution of LEDs in a system for a cooler with a total-height single door. | |
|---|---|
| Luminary | LEDs |
| Heading (811) luminary | 4 |
| Side (831), (841) luminaries | 28 (14 in each side) |
| Bottom (821) luminary | 2 |
| Total | 34 |

FIG. 9*d* schematically depicts the elements and connections between them, illustrating the driver (906) and the connections for the heading (911) luminary with 2 modules of 2 LEDs, the side (931), (941) luminaries with 4 modules of 3 LEDs and 1 module of 2 LEDs each one, and the bottom (921) luminary with 1 module of 2 LEDs. The specifications of the driver and the characteristics of the LEDs for an arrangement like this are shown in Tables 18 and 19.

TABLE 18

| Specifications of the driver for a system for a cooler with a total-height door. | | | |
|---|---|---|---|
| | Minimum | Maximum | Unit |
| Input current (RMS) | 0.077 | .010 | Amp |
| Input voltage (RMS) | 108 | 132 | V |
| Output voltage | 95.2 | 108.8 | V |
| Output current | 0.075 | 0.105 | Amp |
| Output power | 7.14 | 11.424 | Watt |

TABLE 19

| Characteristics of LEDs for a system for a cooler with a middle-height door. | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 7

The lighting system preferred for a narrow commercial cooler of total-height and two doors (1000), illustrated in FIG. 10*a* includes a luminary (or module) for lightening the heading (1010), two more for the bottom zone (1020) and (1030), and two for the sides of each door (1040), (1050), (1060) and (1070). For this lighting system an arrangement is used as the one shown in FIG. 1*b* in serial-parallel; that is, each module comprises 3 LED serial-connected and each module, in turn, is parallel-interconnected with other modules of 3 LEDs, thus allowing the continuous operation of the light source even when with the failure of some of the LEDs of the arrangement. The number of LEDs and its distribution are described in Table 20:

TABLE 20

| Amount and distribution of LEDs in a system for a narrow cooler of total-height and two doors. | |
|---|---|
| Luminary | LEDs |
| Heading (1010) luminary | 24 |
| Side (1040), (1050), (1060), (1070), luminaries | 48 (12 in each side) |
| Bottom (1020) (1030) luminaries | 6 (3 in each door) |
| Total | 78 |

FIG. 10*b* schematically depicts the elements and connections between them, illustrating the driver (1005) and the connections for the heading (1010) luminary with 8 sets of 3 LEDs, the side (1040), (1050), (1060), and (1070), luminaries with 4 blocks of 3 LEDs each one, and the bottom (1020), (1030) luminaries with 1 set of 3 LEDs each one. The specifications of the driver and the characteristics of the LEDs for an arrangement like this are shown in Tables 21 and 22.

TABLE 21

| Specifications of the driver for a system for a narrow cooler of total-height and two doors. | | | |
|---|---|---|---|
| | Minimum | Maximum | Unit |
| Input current (RMS) | | | Amp |
| Input voltage (RMS) | 108 | 132 | V |
| Output voltage | 10 | 11 | V |
| Output current | 2.08 | 2.38 | Amp |
| Output power | 20.8 | 25 | Watt |

TABLE 22

| Characteristics of the LEDs for a system for a narrow cooler of total-height and two doors. | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 8

The lighting system preferred for a narrow commercial cooler of total-height and two doors (1090), illustrated in FIG. 10*c* consists of two luminaries (or modules) for lightening the heading (1011) and (1012), two more for the bottom zone (1021) and (1031), and two for the sides of each door (1041), (1051), (1061) and (1071). For this lighting system an arrangement is used as the one shown in FIG. 1*a*. LEDs are grouped in arrangements of 2 and 3 LEDs, serial-connected, as schematically illustrated in FIG. 1*a*. The number of LEDs and its distribution are described in Table 23:

TABLE 23

| Amount and distribution of LEDs in a system for a narrow cooler of total-height and two doors. | |
|---|---|
| Luminary | LEDs |
| Heading (1011) and (1012) luminary | 8 (4 for each door) |
| Side (1041), (1051), (1061), (1071), luminaries | 56 (14 in each side) |
| Bottom (1021) (1031) luminaries | 4 (2 LED in each door) |
| Total | 68 |

FIG. 10*d* schematically depicts the elements and connections thereof, for one of the doors, being identical the circuit of the other door. The driver (1006) and the connections for the heading (1011) luminary with two modules of 2 LEDs; the side (1041) and (1051) luminaries with 4 modules of 3 LEDs and 1 module of 2 each one, and the bottom (1021) luminary with only 1 module of 2 LEDs are illustrated. The specifications of the driver and the characteristics of the LEDs for an arrangement like this are shown in Tables 24 and 25.

TABLE 24

| Specifications of the driver for a system for a narrow cooler of total-height and two doors. | | | |
|---|---|---|---|
| | Minimum | Maximum | Unit |
| Input current (RMS) | 0.077 | .101 | Amp |
| Input voltage (RMS) | 108 | 132 | V |
| Output voltage | 95.2 | 108.8 | V |
| Output current | 0.075 | 0.105 | Amp |
| Output power | 7.14 | 11.424 | Watt |

TABLE 25

| Characteristics of the LEDs for a system for a narrow cooler of total-height and two doors. | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 9

The lighting system preferred for a wide commercial cooler of total-height and two doors (1100), illustrated in FIG. 11*a* includes two luminaries for lightening the heading (1110), (1120), two more for the bottom zone (1030) and (1040), and two for the sides of each door (1050), (1060), (1070) and (1080). For this lighting system an arrangement is used as the one shown in FIG. 1*b* in serial-parallel; that is, each module comprises 3 LED serial-connected and each module, in turn, is parallel-interconnected with other modules of 3 LEDs, thus allowing the continuous operation of the light source even when with the failure of some of the LEDs of the arrangement. The number of LEDs and its distribution are described in Table 26:

TABLE 26

| Amount and distribution of LEDs in a system for a wide cooler of total-height and two doors. | |
|---|---|
| Luminary | LEDs |
| Heading (1110) and (1120) luminary | 42 (21 for each door) |
| Side (1150), (1160), (1170), (1180), luminaries | 48 (12 in each side) |
| Bottom (1130) (1140) luminaries | 6 (3 LED in each door) |
| Total | 96 |

FIG. 11*b* schematically depicts the elements and connections thereof, for one of the doors, being identical the circuit of the other door. The driver (1105) and the connections for the heading (1110) luminary with 7 sets of 3 LEDs; the side (1150) and (1160) luminaries with 4 blocks of 3 LEDs each one, and the bottom (1130) luminary with only 1 set of 3 LEDs are illustrated. The specifications of the driver and the characteristics of the LEDs for an arrangement like this are shown in Tables 27 and 28.

TABLE 27

| Specifications of the driver for a system for a wide cooler of total-height and two doors. | | | |
|---|---|---|---|
| | Minimum | Maximum | Unit |
| Input current (RMS) | | | Amp |
| Input voltage (RMS) | 108 | 132 | V |
| Output voltage | 10 | 11 | V |
| Output current | 1.28 | 2.38 | Amp |
| Output power | 12.8 | 25 | Watt |

TABLE 28

| Characteristics of the LEDs for a system for a wide cooler of total-height and two doors. | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 10

The lighting system preferred for a wide commercial cooler of total-height and two doors (1009), illustrated in FIG. 11*c* includes 2 luminaries for lightening the heading (1111), (1121), two more for the bottom zone (1031) and (1041), and two for the sides of each door (1051), (1061), (1071) and (1081). For this lighting system an arrangement is used as the one shown in FIG. 1*a*. LEDs are grouped in arrangements of 2 and 3 LEDs, serial-connected, as schematically illustrated in FIG. 1*a*. The number of LEDs and its distribution are described in Table 29:

TABLE 29

Amount and distribution of LEDs in a system for a wide cooler of total-height and two doors.

| Luminary | LEDs |
|---|---|
| Heading (1111), (1121) luminary | 8 (4 for each door) |
| Side (1051), (1061), (1071), (1081), luminaries | 56 (12 in each side) |
| Bottom (1031), (1041) luminaries | 4 (2 LED in each door) |
| Total | 68 |

FIG. 11*c* schematically depicts the elements and connections thereof, for one of the doors, being identical the circuit of the other door. The driver (1106) and the connections for the heading (1111) luminary with two modules of 2 LEDs; the side (1151) and (1161) luminaries with 4 modules of 3 LEDs and 1 module of 2 each one, and the bottom (1130) luminary with only 1 module of 2 LEDs are illustrated. The specifications of the driver and the characteristics of the LEDs for an arrangement like this are shown in Tables 30 and 31.

TABLE 30

Specifications of the driver for a system for a wide cooler of total-height and two doors.

| | Minimum | Maximum | Unit |
|---|---|---|---|
| Input current (RMS) | 0.077 | .101 | Amp |
| Input voltage (RMS) | 108 | 132 | V |
| Output voltage | 95.2 | 108.8 | V |
| Output current | 0.075 | 0.105 | Amp |
| Output power | 7.14 | 11.424 | Watt |

TABLE 31

Characteristics of the LEDs for a system for a wide cooler of total-height and two doors.

| | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 11

The lighting system preferred for a commercial cooler of total-height and three doors (1200), illustrated in FIG. 12*a* includes two luminaries for lightening the heading (1210), (1220), three more for the bottom zone (1230), (1240), and (1250), and two for the sides of each door (1260), (1270), (1280), (1290), (1300) and (1310). For this lighting system an arrangement is used as the one shown in FIG. 1*b* in serial-parallel; that is, each module comprises 3 LED serial-connected and each module, in turn, is parallel-interconnected with other modules of 3 LEDs, thus allowing the continuous operation of the light source even when with the failure of some of the LEDs of the arrangement. The number of LEDs and its distribution are described in Table 32:

TABLE 32

Amount and distribution of LEDs in a system for a cooler of total-height and three doors.

| Luminary | LEDs |
|---|---|
| Heading (1210), (1220) luminary | 48 (24 in each luminary) |
| Side (1260), (1270), (1280), (1290), (1300), (1310) luminaries | 72 (12 in each side) |
| Bottom (1230), (1240), (1250) luminaries | 9 (3 in each door) |
| Total | 129 |

FIG. 12*b* schematically depicts the elements and connections thereof, for heading luminaries, illustrating the driver (1205) and the connections for luminaries (1110) and (1120) with 8 sets of 3 LEDS each one. The specifications of the driver and the characteristics of the LEDs for an arrangement like this are shown in Tables 33 and 34.

TABLE 33

Specifications of the driver for the heading luminaries of a system for a cooler of total-height and three doors.

| | Minimum | Maximum | Unit |
|---|---|---|---|
| Input current (RMS) | | | Amp |
| Input voltage (RMS) | 108 | 132 | V |
| Output voltage | 10 | 11 | V |
| Output current | 1.28 | 2.38 | Amp |
| Output power | 12.8 | 25 | Watt |

TABLE 34

Characteristics of the LEDs for a system for a wide cooler of total-height and two doors.

| | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

FIG. 12*c* schematically depicts the elements and connections thereof, for the doors, illustrating the driver (1107) and the connections for the side (1260), (1270), (1280), (1290), (1300) y (1310) luminaries, with 4 blocks of LEDs each one, and the bottom (1230), (1240) and (1250) luminaries with only 1 set of 3 LEDs, each one. The specifications of the driver and the characteristics of the LEDs for an arrangement like this are shown in Tables 35 and 36.

TABLE 35

Specifications of the driver for a system for a cooler of total-height and three doors.

| | Minimum | Maximum | Unit |
|---|---|---|---|
| Input current (RMS) | | | Amp |
| Input voltage (RMS) | 108 | 132 | V |
| Output voltage | 10 | 11 | V |
| Output current | 2.16 | 2.38 | Amp |
| Output power | 21.6 | 25 | Watt |

TABLE 36

Characteristics of the LEDs for a system for a cooler of total-height and three doors.

| | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

Example 12

The lighting system preferred for a commercial cooler of total-height and three doors (1300), illustrated in FIG. 13*a* includes three luminaries for lightening the heading (1410), (1420), and (1430), three more for the bottom zone (1610), (1620), and (1630), and two for the sides of each door (1510), (1520), (1530), (1540), (1550) and (1560). For this lighting system an arrangement is used as the one shown in FIG. 1*a*. LEDs are grouped in arrangements of 2 and LEDs, serial-connected, as schematically illustrated in FIG. 1*a*. The number of LEDs and its distribution are described in Table 37:

TABLE 37

Amount and distribution of LEDs in a system for a cooler of total-height and three doors.

| Luminary | LEDs |
|---|---|
| Heading (1410, (1420), (1430) luminary | 12 (4 for each door) |
| Side (1510), (1520), (1530), (1540), (1550), and (1560) luminaries | 84 (14 in each side) |
| Bottom (1610), (1620), and (1630) luminaries | 6 (2 in each door) |
| Total | 102 |

FIG. 13*b* schematically depicts the elements and connections thereof, for one of the doors, being identical the circuit of the other 2 doors. The driver (1305) and the connections for the heading (1410) luminary with two modules of 2 LEDs; the side (1510) and (1520) luminaries with 4 modules of 3 LEDs and 1 module of 2 each one, and the bottom (1610) luminary with only 1 module of 2 LEDs are illustrated. The specifications of the driver and the characteristics of the LEDs for an arrangement like this are shown in Tables 38 and 39.

TABLE 38

Specifications of the driver for the heading luminaries of a system for a cooler of total-height and three doors.

| | Minimum | Maximum | Unit |
|---|---|---|---|
| Input current (RMS) | 0.077 | .101 | Amp |
| Input voltage (RMS) | 108 | 132 | V |
| Output voltage | 95.2 | 108.8 | V |
| Output current | 0.075 | 0.105 | Amp |
| Output power | 7.14 | 11.424 | Watt |

TABLE 39

Characteristics of the LEDs for a system for a wide cooler of total-height and two doors.

| | | | |
|---|---|---|---|
| Forward direct current | | 80.00 | mA |
| Forward current peak (1/10 of the duty cycle, 0.1 ms of pulse amplitude) | | 150.00 | mA |
| Forward voltage | 3.00 | 4.00 | V |

It will be observed that in all cases, the drivers with an arrangement as the one shown in FIG. 1*b* in serial-parallel, maintain a current output of 2.38 A and 10.5±0.5 VDC of output voltage with a maximum power of 25 W and with a voltage range of 108-132 VAC. Also, it will be observed that drivers with an arrangement as the one shown in FIG. 1*a* in serial, maintain a maximum current output of 0.105 A and 108.8 VDC of output voltage with a maximum power of 11.424 W and with a voltage range of 108-132 VAC.

With the proposed system in the invention, the power consumption is up to 600 less than with a system based on the fluorescent luminaries, as shown in Table 40. The emission of UV is minimum and virtually not considerable.

TABLE 40

Comparison of operation parameters between lighting systems of fluorescence lamps and LEDs.

| | Lighting Type | |
|---|---|---|
| | Fluorescent | LEDs |
| Lifetime awaiting (hours) | 9,000 | 100,000 |
| Lifetime awaiting (years) | 1.02 | 11.4 |
| Power consumption (watts) | 20 | 8 |
| Annual accrued power | 175.2 | 70.08 |

As may be evident for one skilled in the art, the lighting system proposed in this invention exceeds several problems of the current art, thus offering technical and commercial advantages.

The invention claimed is:

1. A lighting system for an interior space of a refrigeration cabinet having at least one glass door supported by a door frame, the lighting system comprising:

at least two light modules electrically coupled to each other, each light module being mechanically coupled to the door frame adjacent a periphery of the glass door;

each light module including:

a printed circuit board;

a series of LED sets mounted on the printed circuit board, each LED set including two or three LEDs connected in series, wherein each LED is configured to generate light across a projection angle, each LED set being connected in series or in parallel with the other LED sets;

a driver mounted on the printed circuit board and operably coupled to the series of LED sets, the driver including:

a plurality of capacitors connected in parallel and configured to provide a limited current;

a diode bridge receiving the limited current and configured to provide a rectified current signal; and a linear preprogrammed integrated circuit including a resistor receiving the rectified current signal and configured to provide a regulated supply of direct current to the series of LED sets;

a housing defining an interior chamber configured to receive the printed circuit board with LEDs and driver, the housing defining a base portion and a diffusion portion, the diffusion portion including a transparent wall formed with a number of diffusion lines sufficient to diffuse light from the LEDs across a projection angle, wherein the housing mechanically engages the printed circuit board thereby to thermally couple the housing to the LEDs; and a pair of caps sealingly coupled to opposite ends of the housing to hermetically seal the housing interior chamber, each cap being configured to allow electric conductors operably connected to the printed circuit board to pass therethrough.

2. The lighting system of claim 1, in which an incoming current provided to the driver is 80 mA.

3. The lighting system of claim 1, in which the driver has an operation range of 90 to 230 VAC.

4. The lighting system of claim 1, in which each LED has a high luminosity at an input current level of approximately 80 mA.

5. The lighting system of claim 1, in which the projection angle is 120° to 180° .

6. The lighting system of claim 1, in which the printed circuit board is enclosed by an injected plastic cabinet filled with resin.

7. The lighting system of claim 1, in which the housing includes a pair of supports extending partially into the housing interior chamber and securing the printed circuit board within the housing interior chamber, the supports being configured to permit light from each LED to diffuse across a projection angle of 180° .

8. The lighting system of claim 1, in which each cap is formed of a rubber material.

9. The lighting system of claim 1, further comprising an adhesive to secure the caps on the housing.

10. The lighting system of claim 1, in which the diffusion lines are formed on an interior surface of the transparent wall.

11. The lighting system of claim 1, in which the housing is formed of a plastic material resistant to temperature and deformation.

12. The lighting system of claim 11, in which the plastic material comprises polycarbonate.

13. The lighting system of claim 1, further comprising a molding configured to secure each light module to the door frame, and in which the molding is thermally coupled to the housing thereby to further direct heat away from the LEDs.

* * * * *